US010113246B2

(12) United States Patent
Fujikata et al.

(10) Patent No.: US 10,113,246 B2
(45) Date of Patent: Oct. 30, 2018

(54) SUBSTRATE HOLDER, PLATING APPARATUS, AND PLATING METHOD

(71) Applicant: EBARA CORPORATION, Tokyo (JP)

(72) Inventors: Jumpei Fujikata, Tokyo (JP); Yoshio Minami, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 235 days.

(21) Appl. No.: 15/116,197

(22) PCT Filed: Jan. 29, 2015

(86) PCT No.: PCT/JP2015/052456
§ 371 (c)(1),
(2) Date: Aug. 2, 2016

(87) PCT Pub. No.: WO2015/119029
PCT Pub. Date: Aug. 13, 2015

(65) Prior Publication Data

US 2016/0348264 A1 Dec. 1, 2016

(30) Foreign Application Priority Data

Feb. 6, 2014 (JP) ..... 2014-021664
Jun. 18, 2014 (JP) ..... 2014-125537
Dec. 18, 2014 (JP) ..... 2014-256363

(51) Int. Cl.
*C25D 17/06* (2006.01)
*C25D 7/12* (2006.01)
(Continued)

(52) U.S. Cl.
CPC ..... *C25D 17/06* (2013.01); *C25D 17/001* (2013.01); *C25D 17/005* (2013.01);
(Continued)

(58) Field of Classification Search
CPC ... C25D 17/001; C25D 17/005; C25D 17/007
See application file for complete search history.

(56) References Cited

U.S. PATENT DOCUMENTS 8,177,944 B2 * 5/2012 Saito ..... C25D 21/10 204/230.2
2015/0276835 A1 * 10/2015 Minami ..... C25D 7/12 204/229.8

FOREIGN PATENT DOCUMENTS

CN 2604012 Y 2/2004
CN 1922494 A 2/2007
(Continued)

OTHER PUBLICATIONS

International Patent Application No. PCT/JP2015/052456; Int'l Search Report; dated Mar. 17, 2015; 1 page.

*Primary Examiner* — Brian W Cohen
(74) *Attorney, Agent, or Firm* — Baker & Hostetler LLP

(57) ABSTRACT

A substrate holder includes: inner contacts (45) to be brought into contact with a periphery of a substrate (W) for passing an electric current to the substrate; outer contacts (42) each having elasticity, the outer contacts (42) having contact surfaces (42*a*), respectively, to be brought into contact with a feeding terminal (51) coupled to a power source (18), the outer contacts (42) being coupled to the inner contacts (45), respectively; and a conductive block (60) arranged in back of the contact surfaces (42*a*) and located away from the outer contacts (42). The outer contacts (42) are deformable until the outer contacts (42) are brought into contact with the conductive block (60) when the contact surfaces (42*a*) are pressed against the feeding terminal (51).

40 Claims, 49 Drawing Sheets

(51) Int. Cl.
*C25D 17/02* (2006.01)
*C25D 21/12* (2006.01)
*C25D 17/00* (2006.01)

(52) U.S. Cl.
CPC ..... *C25D 17/007* (2013.01); *C25D 17/02* (2013.01); *C25D 21/12* (2013.01)

(56) References Cited

FOREIGN PATENT DOCUMENTS

| | | | |
|---|---|---|---|
| CN | 101281858 | A | 10/2008 |
| CN | 101372754 | A | 2/2009 |
| EP | 1048755 | A1 | 11/2000 |
| EP | 1717591 | A1 | 11/2006 |
| JP | 2003-277995 | A | 10/2003 |
| JP | 2009-155726 | A | 7/2009 |
| JP | 2012-107343 | A | 6/2012 |
| WO | WO 2001/068952 | A1 | 9/2001 |

* cited by examiner

SUBSTRATE HOLDER, PLATING APPARATUS, AND PLATING METHOD

CROSS-REFERENCE TO RELATED APPLICATIONS

This application is the National Stage of International Application No. PCT/JP2015/052456 filed Jan. 29, 2015, which claims the benefit of Japanese Patent Applications No. 2014-021664 filed Feb. 6, 2014, 2014-125537 filed Jun. 18, 2014, and 2014-256363 filed Dec. 18, 2014, the disclosures of which are incorporated herein by reference in their entireties.

TECHNICAL FIELD

The present invention relates to a plating method, a plating apparatus, and a substrate holder for holding a substrate, such as a wafer, used in the plating apparatus.

BACKGROUND ART

There is known a plating apparatus which is configured to hold a wafer, such as a wafer, and immerse the substrate in a plating solution held in a plating tank (see Patent literature 1 and Patent literature 2). As shown in FIG. 55, a substrate holder includes a plurality of inner contacts 100 which are brought into contact with a periphery of a substrate W, and a plurality of outer contacts 101 which are coupled to the inner contacts 100, respectively. Wires 104 that interconnect the inner contacts 100 and the outer contacts 101 are disposed in the substrate holder. When the substrate W is disposed at a predetermined position in the plating tank, the outer contacts 101 are brought into contact with a feeding terminal 103 which is coupled to a power source 102. An electric current is passed through the outer contacts 101 and the inner contacts 100 to the substrate W, so that a metal film is deposited on a surface of the substrate W in the presence of the plating solution.

Conventionally, an electrical resistance between the outer contacts 101 is measured while the substrate W is held on the substrate holder, before plating of the substrate W. The purpose of this is to detect a defect of a conductive layer, such as a seed layer, formed on the surface of the substrate W or a defect of the inner contact 100. Specifically, if a value of an electrical resistance between a certain pair of outer contacts 101 is extremely larger or smaller than a value of an electrical resistance between other pair of outer contacts 101, it can be judged that there is a defect in the conductive layer and/or the inner contacts 100. Therefore, it is possible to detect in advance a failure of plating due to the defect of the conductive layer and/or the inner contact 100 without actually performing the plating.

If the feeding terminal 103 and the outer contacts 101 are in a poor contact, the electrical resistance between the feeding terminal 103 and the outer contacts 101 may change. As a result, non-uniform current may flow through the outer contacts 101 to the inner contacts 100. In particular, a thickness of a conductive layer tends to be thin in recent years. Moreover, there is also a tendency to increase a density of the current to be passed to a substrate W. Therefore, even a slight variation in the electrical resistance between the outer contacts 101 may drastically hinder a uniformity of a thickness of a metal film formed on a substrate W. In order to solve such problem, the outer contacts 101 may be formed by an integral member. However, in this case, the electrical resistance between each pair of outer contacts 101 cannot be measured before plating of a substrate W.

CITATION LIST

Patent Literature

Patent document 1: International Publication No. WO2001/068952

Patent document 2: Japanese laid-open patent publication No. 2009-155726

SUMMARY OF INVENTION

Technical Problem

The present invention has been made in view of the above drawback. It is therefore an object of the present invention to provide a substrate holder, a plating apparatus, and a plating method capable of passing a uniform current to a substrate.

Solution to Problem

In one aspect of the present invention, there is provided a substrate holder comprising: inner contacts to be brought into contact with a periphery of a substrate for passing an electric current to the substrate; outer contacts each having elasticity, the outer contacts having contact surfaces, respectively, to be brought into contact with a feeding terminal coupled to a power source, the outer contacts being coupled to the inner contacts, respectively; and a conductive block arranged in back of the contact surfaces and located away from the outer contacts, wherein the outer contacts are deformable until the outer contacts are brought into contact with the conductive block when the contact surfaces are pressed against the feeding terminal.

In a preferred aspect of the present invention, the conductive block is held by an elastic holding member.

In a preferred aspect of the present invention, the outer contacts have leaf springs, respectively.

In a preferred aspect of the present invention, the conductive block has through-holes, the outer contacts including: conductive rods extending through the through-holes; conductive flanges secured to end portions of the conductive rods, respectively, the conductive flanges having lower surfaces constituting the contact surfaces; and springs biasing the conductive rods in a direction such that the conductive flanges are away from the conductive block.

In another aspect of the present invention, there is provided an apparatus for plating a substrate, comprising: a plating tank for holding a plating solution therein; a substrate holder configured to hold a substrate and place the substrate in the plating tank; an anode disposed in the plating tank so as to face the substrate held by the substrate holder, and a power source configured to apply a voltage between the substrate and the anode, wherein the substrate holder includes: inner contacts to be brought into contact with a periphery of the substrate for passing an electric current to the substrate; outer contacts each having elasticity, the outer contacts having contact surfaces, respectively, to be brought into contact with a feeding terminal coupled to the power source, the outer contacts being coupled to the inner contacts, respectively; and a conductive block arranged in back of the contact surfaces and located away from the outer contacts, wherein the outer contacts are deformable until the outer contacts are brought into contact with the conductive block when the contact surfaces are pressed against the feeding terminal.

In a preferred aspect of the present invention, the conductive block is held by an elastic holding member.

In a preferred aspect of the present invention, the outer contacts have leaf springs, respectively.

In a preferred aspect of the present invention, the apparatus further comprises an auxiliary terminal projecting toward the conductive block, the auxiliary terminal being provided on the feeding terminal, and the auxiliary terminal being brought into contact with the conductive block when the outer contacts are brought into contact with the conductive block.

In a preferred aspect of the present invention, the conductive block has through-holes, the outer contacts including: conductive rods extending through the through-holes; conductive flanges secured to end portions of the conductive rods, respectively, the conductive flanges having lower surfaces constituting the contact surfaces; and springs biasing the conductive rods in a direction such that the conductive flanges are away from the conductive block.

In still another aspect of the present invention, there is provided a method of plating a substrate using a substrate holder having inner contacts for passing an electric current to the substrate, and outer contacts to be brought into contact with a feeding terminal coupled to a power source, the method comprising: bringing the inner contacts into contact with a periphery of the substrate; measuring an electrical resistance between the outer contacts by a resistance-measuring device which is brought into contact with the outer contacts, while establishing a contact between first intermediate contacts and second intermediate contacts, the first intermediate contacts being electrically connected to the inner contacts, respectively, and the second intermediate contacts being electrically connected to the outer contacts, respectively, inserting a conductive block between the first intermediate contacts and the second intermediate contacts until the conductive block is in contact with the first intermediate contacts and the second intermediate contacts, thereby electrically connecting the first intermediate contacts and the second intermediate contacts to each other through the conductive block; bringing the outer contacts into contact with the feeding terminal while immersing the substrate in a plating solution; and plating the substrate by applying a voltage between an anode disposed in the plating solution and the substrate.

In a preferred aspect of the present invention, the method further comprises, before bringing the inner contacts into contact with the periphery of the substrate, inserting the conductive block between the first intermediate contacts and the second intermediate contacts and measuring an electrical resistance between the outer contacts by the resistance-measuring device which is brought into contact with the outer contacts.

In still another aspect of the present invention, there is provided an apparatus for plating a substrate, comprising: a plating tank for holding a plating solution therein; an anode disposed in the plating tank; a substrate holder for holding a substrate; a power source configured to apply a voltage between the anode and the substrate; and a resistance-measuring device configured to measure an electrical resistance between outer contacts of the substrate holder, wherein the substrate holder includes: inner contacts to be brought into contact with a periphery of the substrate; first intermediate contacts electrically connected to the inner contacts, respectively; the outer contacts to be brought into contact with a feeding terminal coupled to the power source; second intermediate contacts electrically connected to the outer contacts, respectively; and a conductive block being movable between a first position and a second position, the first position being a position at which the conductive block is sandwiched between the first intermediate contacts and the second intermediate contacts, and the second position being a position at which the conductive block is away from the first intermediate contacts and the second intermediate contacts, wherein when the conductive block is located at the first position, the conductive block is in contact with the first intermediate contacts and the second intermediate contacts to electrically connect the first intermediate contacts and the second intermediate contacts to each other through the conductive block, and when the conductive block is located at the second position, the first intermediate contacts are brought into contact with the second intermediate contacts, respectively, and the first intermediate contacts and the second intermediate contacts are electrically connected to each other.

In a preferred aspect of the present invention, the substrate holder further includes a holder hanger to which the outer contacts are attached, and the first intermediate contacts, the second intermediate contacts, and the conductive block are housed in the holder hanger.

In a preferred aspect of the present invention, the apparatus further comprises wires extending from the inner contacts to the first intermediate contacts, respectively, the wires being made of metal having an electrical resistance higher than an electrical resistance of copper.

In a preferred aspect of the present invention, the wires are made of copper nickel alloy.

In a preferred aspect of the present invention, the wires have the same length as each other.

In still another aspect of the present invention, there is provided a substrate holder comprising: inner contacts to be brought into contact with a periphery of a substrate; first intermediate contacts electrically connected to the inner contacts, respectively; the outer contacts to be brought into contact with a feeding terminal coupled to a power source; second intermediate contacts electrically connected to the outer contacts, respectively; and a conductive block being movable between a first position and a second position, the first position being a position at which the conductive block is sandwiched between the first intermediate contacts and the second intermediate contacts, and the second position being a position at which the conductive block is away from the first intermediate contacts and the second intermediate contacts, wherein when the conductive block is located at the first position, the conductive block is in contact with the first intermediate contacts and the second intermediate contacts to electrically connect the first intermediate contacts and the second intermediate contacts to each other through the conductive block, and when the conductive block is located at the second position, the first intermediate contacts are brought into contact with the second intermediate contacts, respectively, and the first intermediate contacts and the second intermediate contacts are electrically connected to each other.

In still another aspect of the present invention, there is provided a substrate holder comprising: inner contacts to be brought into contact with a periphery of a substrate; outer contacts each having elasticity, the outer contacts having contact surfaces, respectively, to be brought into contact with a feeding terminal coupled to a power source, the outer contacts being coupled to the inner contacts, respectively; a conductive block arranged in back of the contact surfaces;

and a biasing member configured to press the conductive block against the outer contacts.

In a preferred aspect, each of the outer contacts comprises a first contact which is in contact with the conductive block, and a second contact extending in a direction away from the conductive block, and the first contact and the second contact are electrically connected to each other.

In a preferred aspect, each of the outer contacts comprises a first projecting portion which is in contact with the conductive block, and a second projecting portion projecting in a direction away from the conductive block.

In a preferred aspect, the first projecting portion is a first bent portion projecting toward the conductive block, and the second projecting portion is a second bent portion projecting in a direction away from the conductive block.

In a preferred aspect of the present invention, the conductive block is housed in a holder hanger to which the outer contacts are attached.

In a preferred aspect, the substrate holder further comprises wires which couple the inner contacts to the outer contacts, respectively, the wires being made of copper nickel alloy.

In a preferred aspect, the wires have the same length as each other.

In still another aspect of the present invention, there is provided an apparatus for plating a substrate, comprising: a plating tank for holding a plating solution therein; a substrate holder configured to hold a substrate and place the substrate in the plating tank; an anode disposed in the plating tank; a power source configured to apply a voltage between the substrate and the anode; and a feeding terminal coupled to the power source, wherein the substrate holder comprises: inner contacts to be brought into contact with a periphery of the substrate; outer contacts each having elasticity, the outer contacts having contact surfaces, respectively, to be brought into contact with the feeding terminal, the outer contacts being coupled to the inner contacts, respectively; a conductive block arranged in back of the contact surfaces; and a biasing member configured to press the conductive block against the outer contacts.

In a preferred aspect, each of the outer contacts comprises a first contact which is in contact with the conductive block, and a second contact extending in a direction away from the conductive block, and the first contact and the second contact are electrically connected to each other.

In a preferred aspect, each of the outer contacts comprises a first projecting portion which is in contact with the conductive block, and a second projecting portion projecting in a direction away from the conductive block.

In a preferred aspect, the first projecting portion is a first bent portion projecting toward the conductive block, and the second projecting portion is a second bent portion projecting in a direction away from the conductive block.

In a preferred aspect, the substrate holder includes a holder hanger to which the outer contacts are attached, and the conductive block is housed in the holder hanger.

In a preferred aspect, the apparatus further comprises wires which couple the inner contacts to the outer contacts, respectively, the wires being made of copper nickel alloy.

In a preferred aspect, the wires have the same length as each other.

In a preferred aspect, the apparatus further comprises an auxiliary terminal provided on the feeding terminal and configured to be able to come into contact with the conductive block.

In a preferred aspect, the apparatus further comprises a resistance-measuring device configured to measure an electrical resistance between the outer contacts, the resistance-measuring device including: probes being able to come into contact with the outer contacts; and a protrusion configured to separate the conductive block from the outer contacts.

In still another aspect of the present invention, there is provided a method of plating a substrate using a substrate holder having inner contacts for passing an electric current to the substrate, and further having outer contacts each having an elasticity, the outer contacts being coupled to the inner contacts, respectively, the method comprising: electrically connecting the outer contacts to each other through a conductive block by pressing the conductive block against the outer contacts by a biasing member; holding the substrate with the substrate holder and bringing the inner contacts into contact with a periphery of the substrate; bringing the outer contacts into contact with a feeding terminal on a plating tank while immersing the substrate in a plating solution in the plating tank; and plating the substrate by applying a voltage between an anode and the substrate which are immersed in the plating solution.

In a preferred aspect, the method further comprises, before holding the substrate with the substrate holder, measuring an electrical resistance between the outer contacts by a resistance-measuring device which is brought into contact with the outer contacts.

In a preferred aspect, the method further comprises separating the conductive block from the outer contacts when the substrate holder is holding the substrate; and measuring an electrical resistance between the outer contacts by a resistance-measuring device which is brought into contact with the outer contacts while the conductive block is kept away from the outer contacts.

Advantageous Effects of Invention

According to the present invention, when the contact surfaces of the outer contacts are pressed against the feeding terminal, the outer contacts are brought into contact with the conductive block, and the outer contacts are electrically connected to each other through the conductive block. Therefore, the electric current flowing in the outer contacts becomes uniform. As a result, the uniform current is passed through the inner contacts to the substrate, and a metal film with a uniform thickness can be formed on a surface of a substrate.

According to the present invention, when the conductive block is sandwiched between the first intermediate contact and the second intermediate contact, all of the inner contacts and all of the outer contacts are electrically connected to each other through the conductive block. Therefore, the electric current flowing into the inner contacts becomes uniform through the conductive block. As a result, a metal film with a uniform thickness can be formed on a surface of a substrate.

According to the present invention, because the biasing member presses the conductive block against the outer contacts, all of the outer contacts are electrically connected to each other through the conductive block. Therefore, the electric current flowing into the inner contacts becomes uniform through the conductive block. As a result, a metal film with a uniform thickness can be formed on a surface of a substrate.

DESCRIPTION OF EMBODIMENTS

Figure 1:
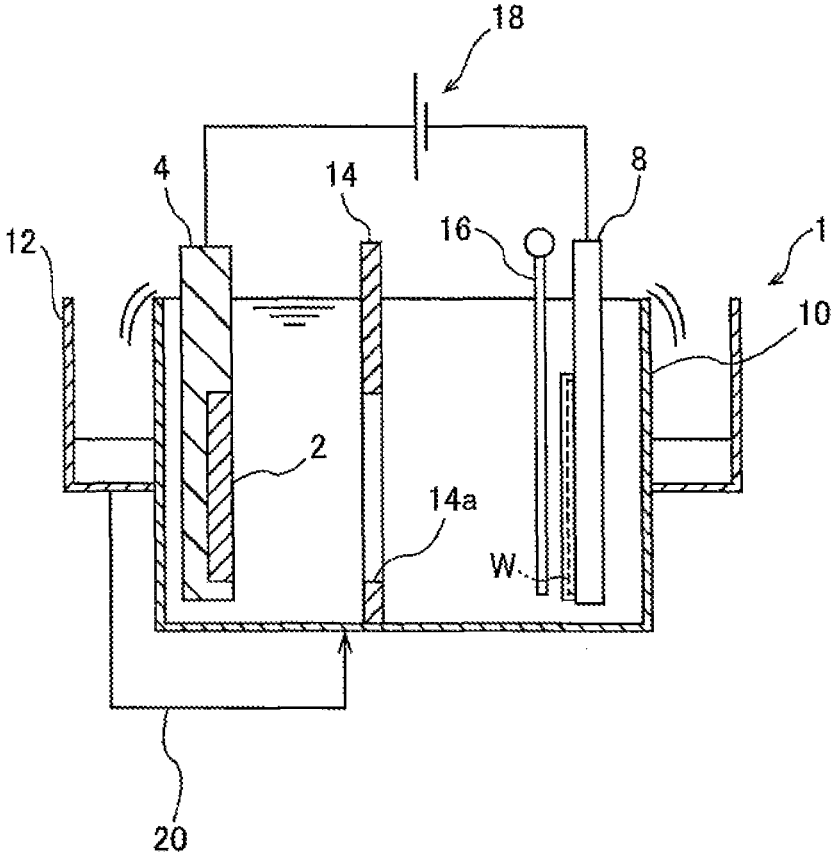
FIG. 1 is a schematic view showing a plating apparatus.
Figure 2:
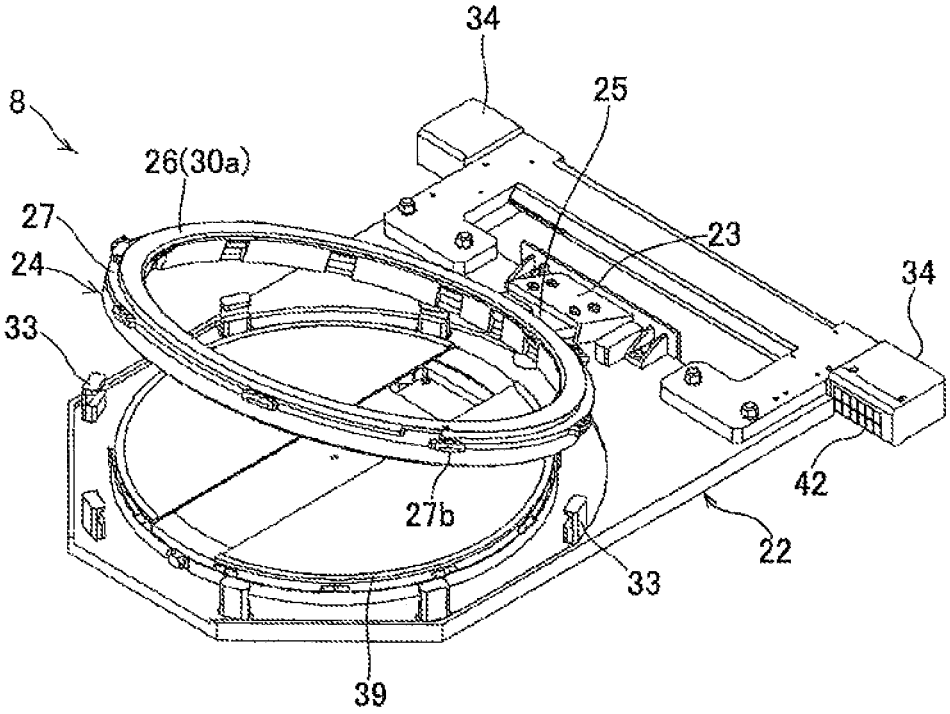
FIG. 2 is a perspective view showing an embodiment of a substrate holder.
Figure 54:
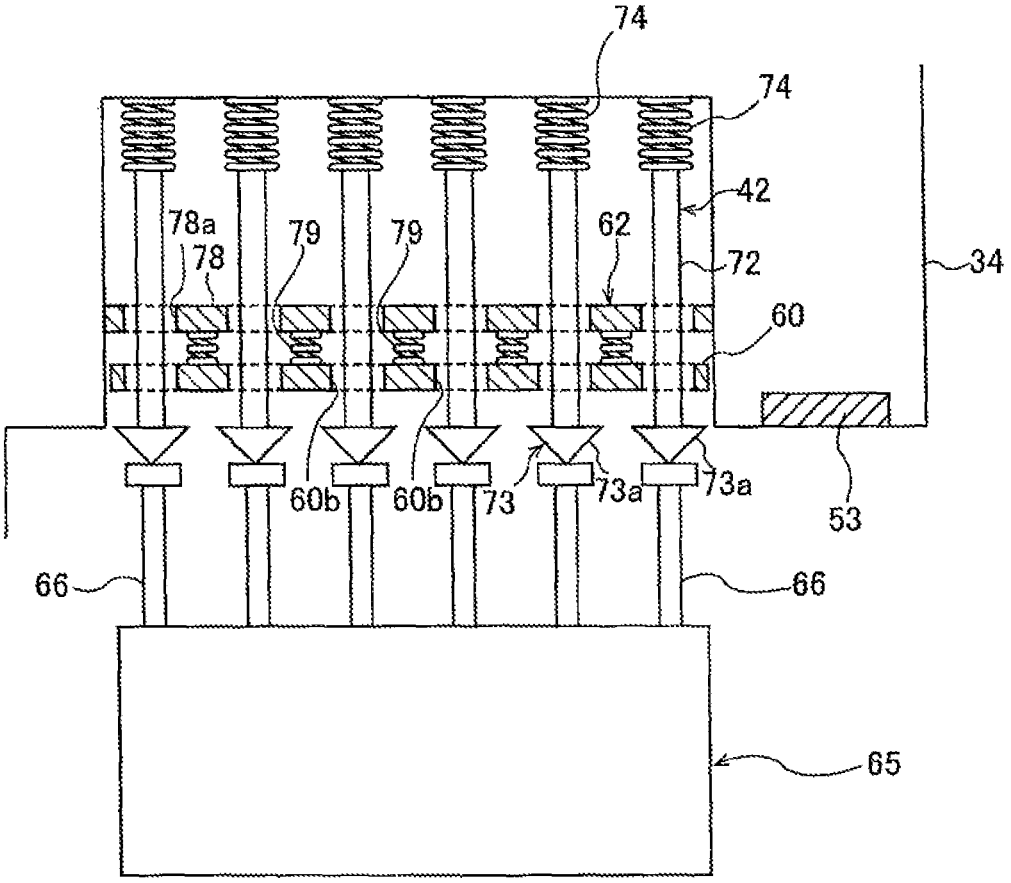
FIG. 54 is a view showing the resistance-measuring device which is brought into contact with contact surfaces of conductive flanges.
Figure 55:
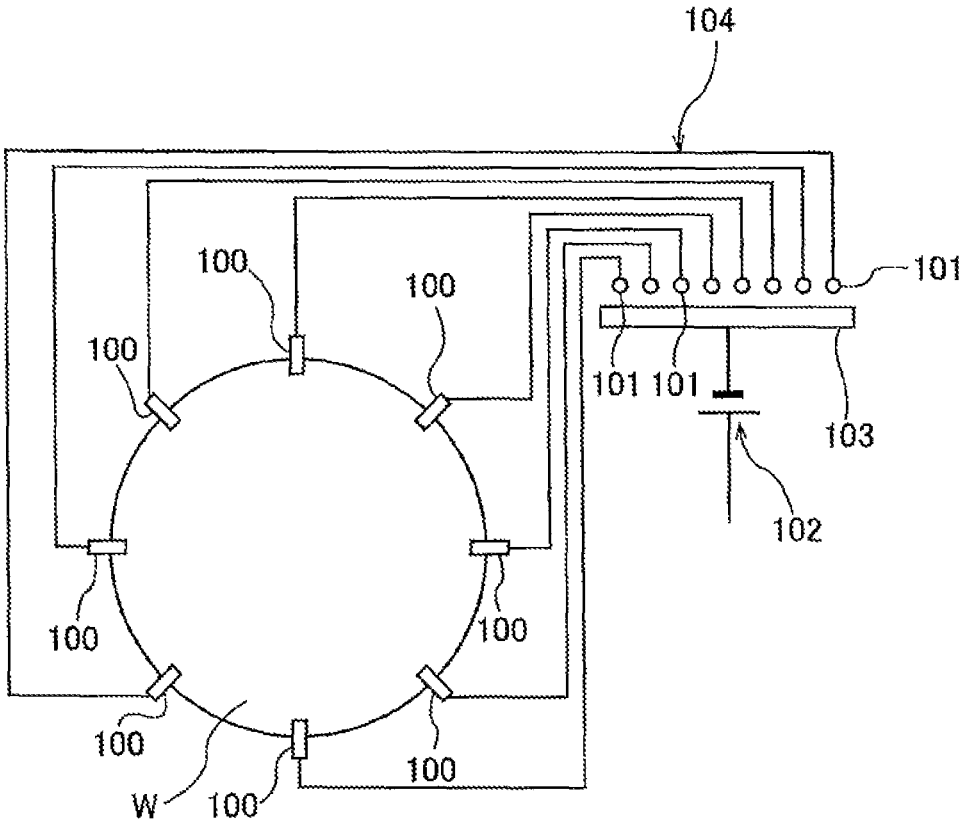
FIG. 55 is a view showing a plurality of outer contacts which are coupled to a plurality of inner contacts.

Embodiments will now be described with reference to the drawings. In FIG. 1 through FIG. 54, the same reference numerals are used to refer to the same or corresponding elements, and duplicate descriptions thereof will be omitted. FIG. 1 is a schematic view showing a plating apparatus. As shown in FIG. 1, the plating apparatus includes a plating tank 1 for holding a plating solution therein, an anode 2 disposed in the plating tank 1, an anode holder 4 configured to hold the anode 2 and immerse the anode 2 in the plating solution held in the plating tank 1, and a substrate holder 8 configured to detachably hold a substrate W and immerse the substrate W in the plating solution held in the plating tank 1.

The plating tank 1 includes a storing tank 10 in which the substrate W, held by the substrate holder 8, and the anode 2 are disposed, and an overflow tank 12 adjacent to the storing tank (or inner tank) 10. The plating solution in the storing tank 10 overflows a side wall of the storing tank 10 into the overflow tank 12. The anode 2 and the substrate W are disposed opposite each other in the storing tank 10.

As shown in FIG. 1, the plating apparatus further includes a regulation plate 14 having an opening 14*a* for regulating an electric potential distribution on the substrate W, and a paddle 16 for agitating the plating solution in the storing tank 10. The regulation plate 14 is disposed between the anode 2 and the substrate W. The paddle 16 is disposed near a surface of the substrate W held by the substrate holder 8 in the storing tank 10. The paddle 16 is disposed in a vertical position, and is configured to reciprocate parallel to the substrate W to thereby agitate the plating solution, so that a sufficient amount of metal ions can be supplied uniformly to the surface of the substrate W.

The anode 2 is coupled to a positive electrode of a power source 18 through the anode holder 4, and the substrate W is coupled to a negative electrode of the power source 18 through the substrate holder 8. When a voltage is applied between the anode 2 and the substrate W, a current is passed to the substrate W, so that a metal film is formed on the surface of the substrate W in the presence of the plating solution.

One end of a plating-solution circulation line 20 is coupled to a bottom of the overflow tank 12, and other end of the plating-solution circulation line 20 is coupled to a bottom of the storing tank 10. The plating solution overflows the side wall of the storing tank 10 into the overflow tank 12, and is returned from the overflow tank 12 to the storing tank 10 through the plating-solution circulation line 20. In this manner, the plating solution circulates between the storing tank 10 and the overflow tank 12 through the plating-solution circulation line 20.

The substrate holder 8 will now be described with reference to FIG. 2 through FIG. 5. As shown in FIG. 2 through FIG. 5, the substrate holder 8 includes a first holding member 22 having a rectangular plate shape, and a second holding member 24 rotatably coupled to the first holding member 22 through a hinge 23. In another example, it is also possible to dispose the second holding member 24 opposite to the first holding member 22 and to move the second holding member 24 away from and toward the first holding member 22 to thereby open and close the second holding member 24.

The first holding member 22 may be made of vinyl chloride. The second holding member 24 includes a base portion 25 and a ring-shaped seal holder 26. The seal holder 26 may be made of vinyl chloride. An annular substrate-side sealing member 28 (see FIG. 4 and FIG. 5), projecting inwardly, is fixed to an upper portion of the seal holder 26. This substrate-side sealing member 28 is brought into pressure contact with a circumferential portion of the surface of the substrate W to seal a gap between the substrate W and the second holding member 24 when the substrate W is held by the substrate holder 8. An annular holder-side sealing member 29 (see FIG. 4 and FIG. 5) is fixed to a surface, facing the first holding member 22, of the seal holder 26. This holder-side sealing member 29, when the substrate holder 8 holds the substrate W, is brought into pressure contact with the first holding member 22 to seal a gap between the first holding member 22 and the second holding member 24. The holder-side sealing member 29 is located outwardly of the substrate-side sealing member 28.

Figure 5:
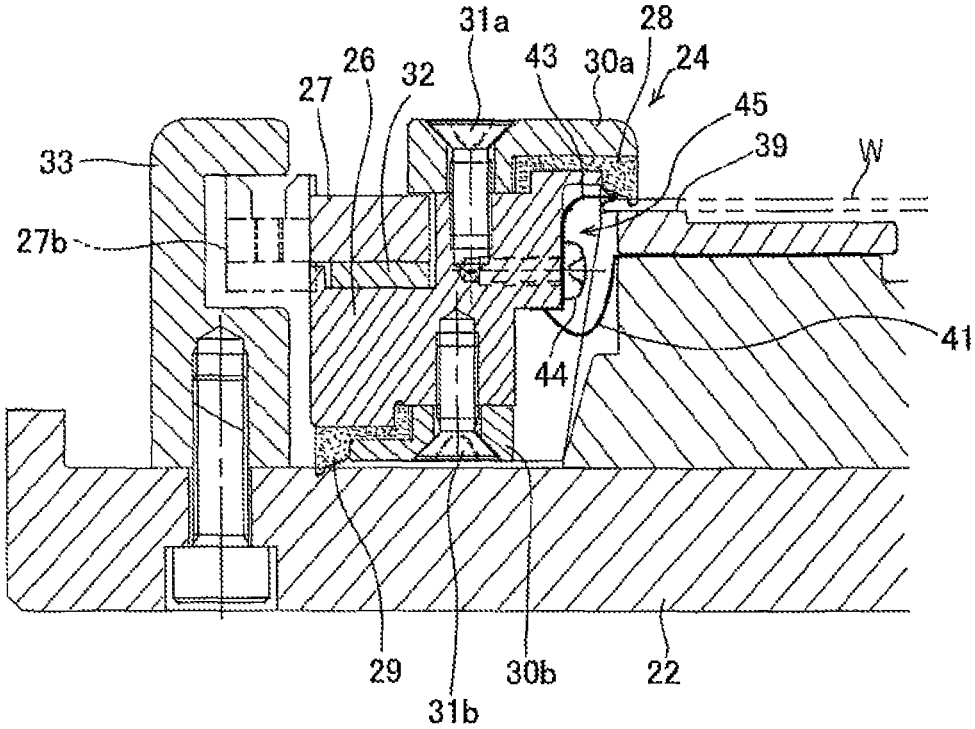
FIG. 5 is an enlarged view showing an encircled area indicated by symbol A shown in FIG. 4.

As shown in FIG. 5, the substrate-side sealing member 28 is sandwiched between the seal holder 26 and a first mounting ring 30*a*, so that the substrate-side sealing member 28 is attached to the seal holder 26. The first mounting ring 30*a* is secured to the seal holder 26 by fastening tools 31*a*, such as screws. The holder-side sealing member 29 is sandwiched between the seal holder 26 and a second mounting ring 30*b*, so that the holder-side sealing member 29 is attached to the seal holder 26. The second mounting ring 30*b* is secured to the seal holder 26 by fastening tools 31*b*, such as screws.

The seal holder 26 has a stepped portion at a periphery thereof, and the retaining ring 27 is rotatably mounted to the stepped portion through a spacer 32. The retaining ring 27 is inescapably held by a peripheral portion of the first mounting ring 30*a*. This retaining ring 27 is made of a material (e.g., titanium) having high rigidity and excellent acid and alkali corrosion resistance, and the spacer 32 is made of a material having a low friction coefficient, for example PTFE, so that the retaining ring 27 can rotate smoothly.

Inverted L-shaped clampers 33, each having an inwardly projecting portion and located outside of the retaining ring 27, are fixed to the first holding member 22 at equal intervals along a circumferential direction of the retaining ring 27. The retaining ring 27 has outwardly projecting portions 27*b* on a circumferential surface of the retaining ring 27 at positions corresponding to positions of the clampers 33. A lower surface of the inwardly projecting portion of each clamper 33 and an upper surface of each projecting portion 27*b* of the retaining ring 27 are inclined in opposite directions along the rotational direction of the retaining ring 27 to form inclined surfaces. A plurality of (e.g., three) upwardly protruding dots 27*a* are provided on the retaining ring 27 at positions along the circumferential direction of the retaining ring 27. The retaining ring 27 can be rotated by pushing and moving each dot 27*a* from a lateral direction by means of a rotating pin (not shown).

When the second holding member 24 is open, the substrate W is inserted into the central portion of the first holding member 22. The second holding member 24 is then closed through the hinge 23. Subsequently the retaining ring 27 is rotated clockwise so that each projecting portion 27*b* of the retaining ring 27 slides into the inwardly projecting portion of each clamper 33. As a result, the first holding member 22 and the second holding member 24 are fastened to each other and locked by engagement between the inclined surfaces of the retaining ring 27 and the inclined surfaces of the clampers 33. The lock of the second holding member 24 can be released by rotating the retaining ring 27 counterclockwise to disengage the projecting portions 27*b* of the retaining ring 27 from the clampers 33.

When the second holding member 24 is locked, the downwardly-protruding portion of the substrate-side sealing member 28 is placed in pressure contact with the circumferential portion of the surface of the substrate W. The sealing member 28 is pressed uniformly against the substrate W, thereby sealing the gap between the circumferential portion of the surface of the substrate W and the second holding member 24. Similarly, when the second holding member 24 is locked, the downwardly-protruding portion of the holder-side sealing member 29 is placed in pressure contact with the surface of the first holding member 22. The sealing member 29 is uniformly pressed against the first holding member 22, thereby sealing the gap between the first holding member 22 and the second holding member 24.

Figure 3:
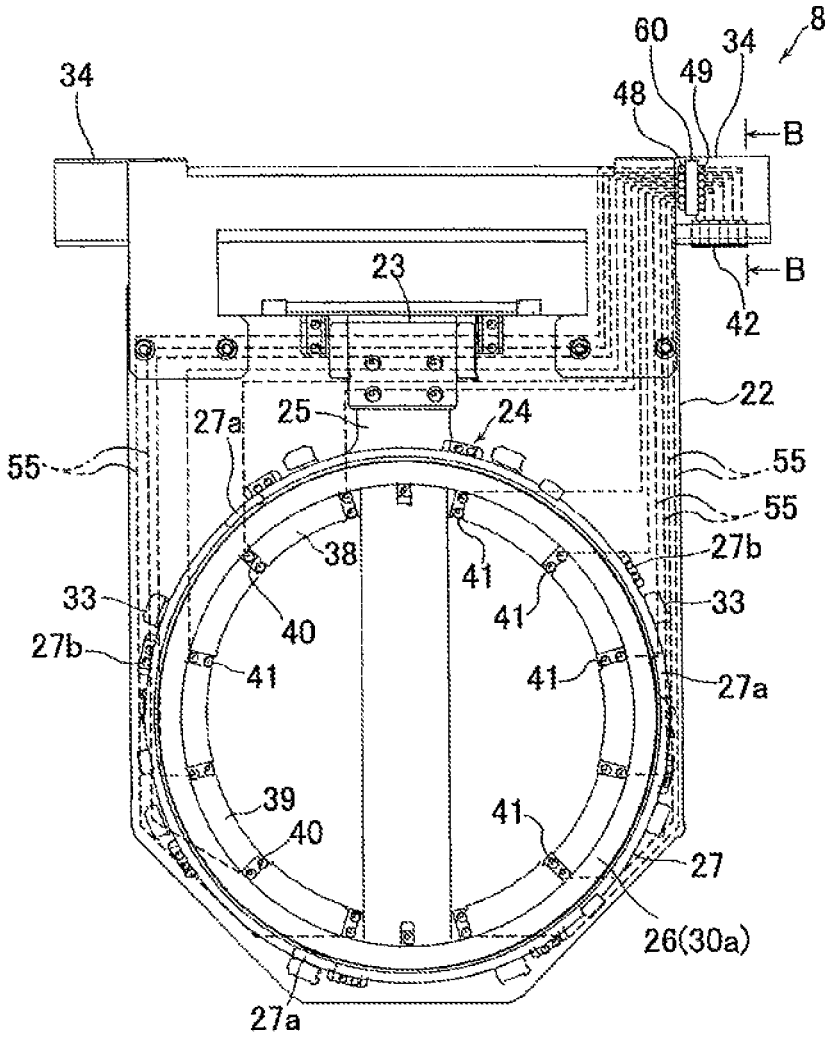
FIG. 3 is a plan view showing the substrate holder shown in FIG. 2.
Figure 4:
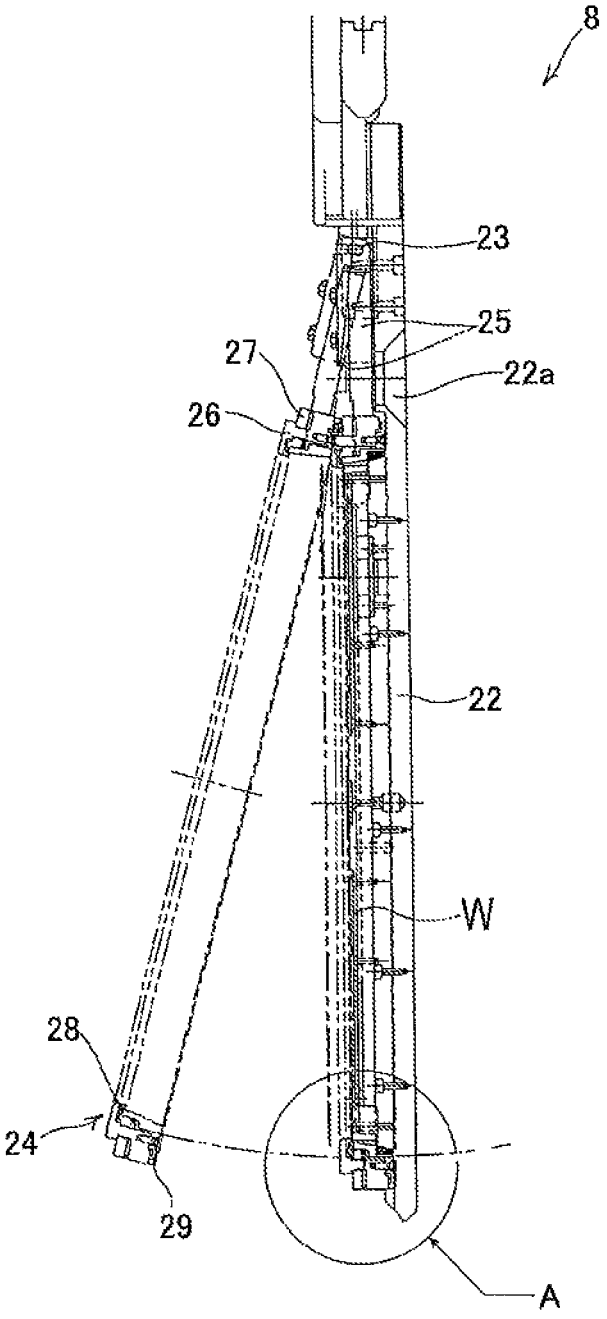
FIG. 4 is a right-side view showing the substrate holder shown in FIG. 2.

As shown in FIG. 3, a protruding portion 38, which is in a ring shape corresponding to a size of the substrate W, is formed on a surface of the first holding member 22. The protruding portion 38 has an annular support surface 39 which is placed in contact with a periphery of the substrate W to support the substrate W. The protruding portion 38 has recesses 40 arranged at predetermined positions along a circumferential direction of the protruding portion 38.

The substrate holder 8 further includes a plurality of inner contacts 45 (see FIG. 5) which are brought into contact with the periphery of the substrate W so as to pass electric current to the substrate W. Each inner contact 45 includes a conductive member 41 and a contact member 43. The contact member 43 is brought into contact with the conductive member 41 and the periphery of the substrate W. As shown in FIG. 3, a plurality of (twelve in FIG. 12) the conductive members 41 are secured to the recesses 40.

The conductive members 41 are attached to the first holding member 22, and the contact members 43 are attached to the second holding member 24. Therefore, when the second holding member 24 is open, the contact members 43 are away from the conductive members 41. When the second holding member 24 is closed with the substrate W mounted on the support surface 39 of the first holding member 22, the contact members 43 are elastically brought into contact with end portions of the conductive members 41 as shown in FIG. 5. The contact members 43 are provided as many as the conductive members 41 (twelve contact members 43 in this embodiment). Twelve inner contacts 45 are provided in this embodiment.

The contact members 43, which are to be electrically connected to the conductive members 41, are secured to the seal holder 26 of the second holding member 24 by fastening tools 44, such as screws (see FIG. 5). The contact members 43 have leaf spring-like contact portions, respectively, which are located outside the substrate-side sealing member 28 and project inwardly. These contact portions of the contact members 43 are springy and bend easily. When the substrate W is sandwiched between the first holding member 22 and the second holding member 24, the contact portions of the contact members 43 make elastic contact with the periphery of the substrate W supported on the support surface 39 of the first holding member 22, and lower portions of the contact members 43 make contact with the conductive members 41.

The second holding member 24 is opened and closed by a not-shown pneumatic cylinder and by the own weight of the second holding member 24. More specifically, the first holding member 22 has a through-hole 22*a*. The second holding member 24 is opened by extending a piston rod of the pneumatic cylinder (not shown) through the through-hole 22*a* to push up the seal holder 26 of the second holding member 24. The second holding member 24 is closed by its own weight when the piston rod is retracted.

As shown in FIG. 3, the first holding member 22 has at its end portion a pair of holder hangers 34. A plurality of outer contacts 42 are attached to one of the two holder hangers 34. While six outer contacts 42 are shown in FIG. 3, other six outer contacts 42 are disposed behind the outer contacts 42 shown in FIG. 3, as can be seen from FIG. 2. Therefore, a total of twelve outer contacts 42 are provided.

A plurality of (twelve in this embodiment) first intermediate contacts 48, one conductive block 60, and a plurality of (twelve in this embodiment) second intermediate contacts 49 are disposed in the holder hanger 34. The inner contacts 45 are electrically connected to the first intermediate contacts 48 through the plurality of wires 55, respectively. The wires 55 extend from the inner contacts 45 to the first intermediate contacts 48. These wires 55 are disposed in the substrate holder 8, and the twelve wires 55 have the same length as each other. The outer contacts 42 are electrically connected to the second intermediate contacts 49, respectively.

The first intermediate contacts 48 and the second intermediate contacts 49 are made of conductive material. The first intermediate contacts 48 are separated from each other, and the second intermediate contacts 49 also are separated from each other. The conductive block 60 is also made of conductive material. For example, the conductive block 60 is made of copper plated with gold or platinum. The conductive block 60 is disposed between the first intermediate contacts 48 and the second intermediate contacts 49. The conductive block 60 is in contact with all of the first intermediate contacts 48 and all of the second intermediate contacts 49. Therefore, the first intermediate contacts 48 and the second intermediate contacts 49 are electrically connected to each other through the conductive block 60.

Figure 6:
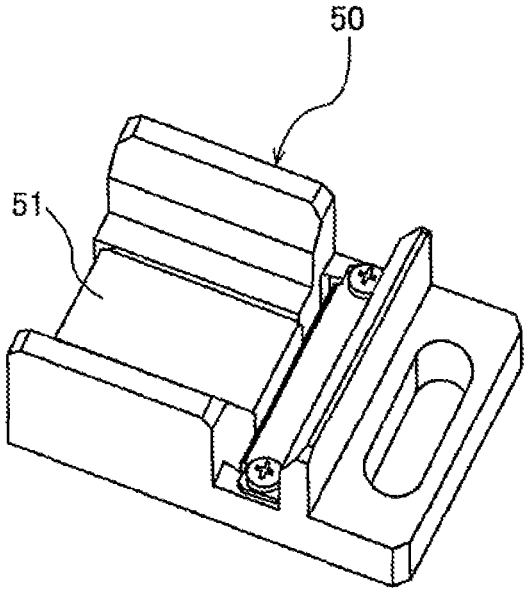
FIG. 6 is a view showing a holder support member secured to a surrounding wall of a plating tank.

When the holder hangers 34 of the substrate holder 8 are mounted on a surrounding wall of the plating tank 1, the substrate holder 8 is suspended in the plating tank 1. FIG. 6 is a view showing a holder support member 50 secured to the surrounding wall of the plating tank 1. The holder support member 50 for supporting the holder hanger 34, provided with the outer contacts 42, is secured to the surrounding wall of the plating tank 1. A feeding terminal 51, which is coupled to the power source 18, is provided in the holder support member 50. When the substrate holder 8 is disposed at a predetermined position in the plating tank 1, the outer contacts 42 of the substrate holder 8 are brought into contact with the feeding terminal 51.

Figure 7:
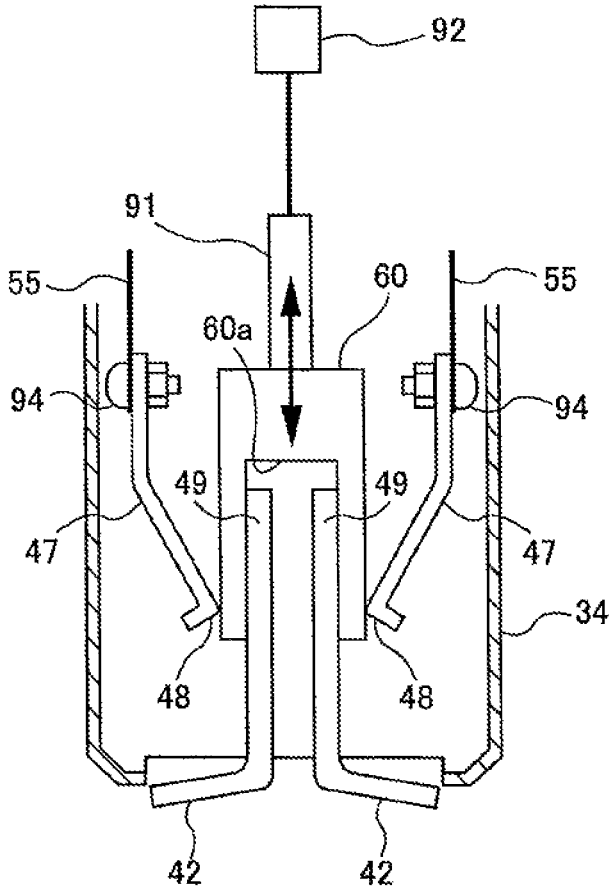
FIG. 7 is a schematic view of a cross section taken along line B-B of FIG. 3.

FIG. 7 is a schematic view of a cross section taken along line B-B of FIG. 3. As shown in FIG. 7, each first intermediate contact 48 is connected to a leaf spring 47 serving as a biasing device. The first intermediate contact 48 and the leaf spring 47 are integrally formed by the same conductive material. The first intermediate contact 48 itself may be in a form of a leaf spring. The first intermediate contacts 48 are elastically brought into contact with an outer surface of the conductive block 60 by the leaf springs 47. A groove 60*a* is formed in a lower surface of the conductive block 60. The second intermediate contacts 49 are in contact with an inner surface, which forms the groove 60*a*, of the conductive block 60.

The leaf springs 47 bias the first intermediate contacts 48 toward the second intermediate contacts 49. Instead of the first intermediate contacts 48, the second intermediate contacts 49 may be connected to leaf springs. In this case, the leaf springs bias the second intermediate contacts 49 toward the first intermediate contacts 48. Both of the first intermediate contacts 48 and the second intermediate contacts 49 may be connected to leaf springs, respectively. Instead of the leaf springs, coil springs may be used as the biasing devices. Each outer contact 42 and each second intermediate contact 49 are integrally formed by the same conductive material. In another embodiment, each outer contact 42 and each intermediate contact 49 may be coupled to each other through wire.

The first intermediate contacts 48, the second intermediate contacts 49, and the conductive block 60 are housed in the holder hanger 34, and are not exposed to the outside. This arrangement can prevent a foreign matter from being attached to surfaces of the first intermediate contacts 48, the second intermediate contacts 49, and the conductive block 60. The first intermediate contacts 48 are coupled to the wires 55 by fastening tools 94, respectively. Therefore, the first intermediate contacts 48 are electrically connected to the inner contacts 45 through the wires 55.

Figure 8:
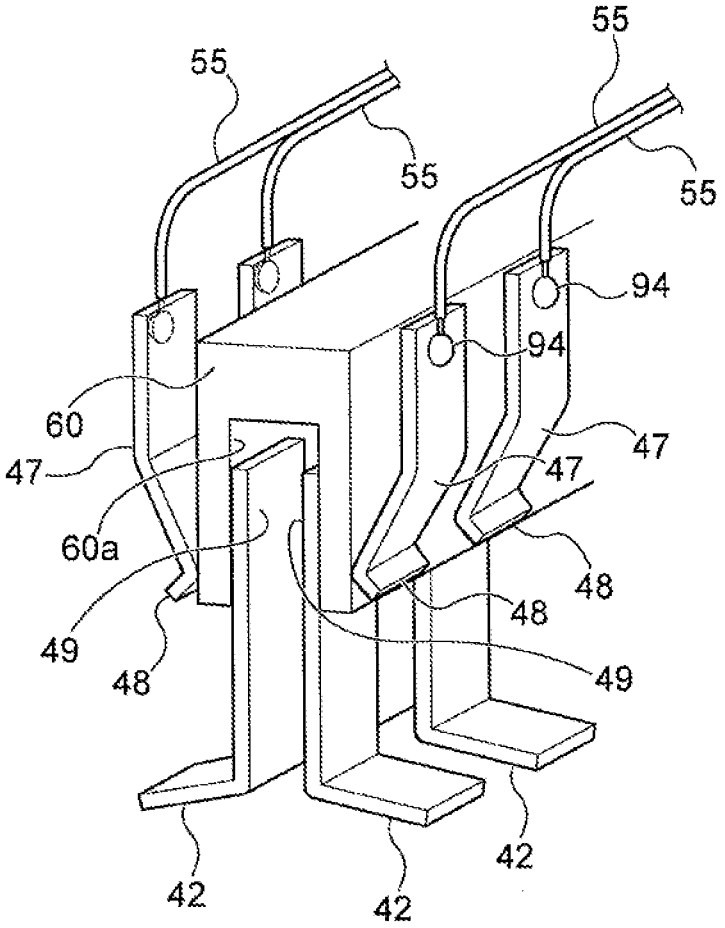
FIG. 8 is a perspective view of outer contacts, a conductive block, first intermediate contacts, and second intermediate contacts shown in FIG. 7.

FIG. 8 is a perspective view of the outer contacts 42, the conductive block 60, the first intermediate contacts 48, and the second intermediate contacts 49. As shown in FIG. 8, the conductive block 60 extends along an arrangement direction of the first intermediate contacts 48 and the second intermediate contacts 49. The groove 60*a* of the conductive block 60 also extends along the arrangement direction of the first intermediate contacts 48 and the second intermediate contacts 49. Although not shown in the drawings, twelve first intermediate contacts 48 and twelve second intermediate contacts 49 are disposed in the holder hanger 34.

As shown in FIG. 7, the plating apparatus includes a conductive-block moving device 92 configured to move the conductive block 60. The conductive-block moving device 92 is detachably coupled to the conductive block 60 through a coupling block 91. As indicated by arrow shown in FIG. 7, the conductive-block moving device 92 is configured to move the conductive block 60 in directions closer to and away from the first intermediate contacts 48 and the second intermediate contacts 49. A linear actuator, such as a pneumatic cylinder, can be used as the conductive-block moving device 92. The coupling block 91 is secured to the conductive block 60, and is exposed to the outside beyond the holder hanger 34. The conductive-block moving device 92 is disposed outside the substrate holder 8. The conductive-block moving device 92 is configured to be able to be connected to and disconnected from the coupling block 91.

Figure 9:
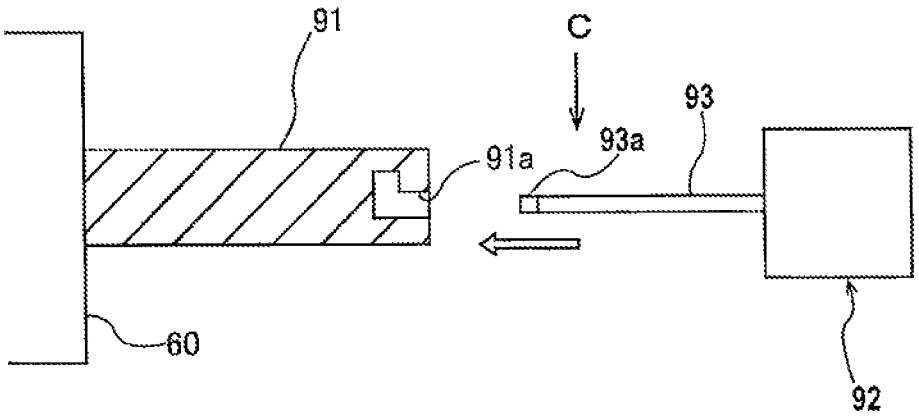
FIG. 9 is a view showing an embodiment of a conductive-block moving device.
Figure 10:
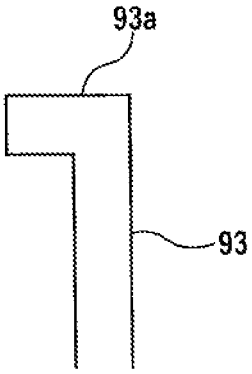
FIG. 10 is a view of a coupling rod as viewed from a direction indicated by arrow C of FIG. 9.

An embodiment of the conductive-block moving device 92 will now be described. FIG. 9 is a view showing an embodiment of the conductive-block moving device 92. As shown in FIG. 9, the coupling block 91 has a mortise 91*a* whose cross section is in an L-shape. The conductive-block moving device 92 includes a coupling rod 93 which can be inserted into the mortise 91*a* of the coupling block 91. FIG. 10 is a view of the coupling rod 93 as viewed from a direction indicated by arrow C of FIG. 9. As shown in FIG. 10, the coupling rod 93 has an L-shaped tip 93*a*.

Figure 11A:
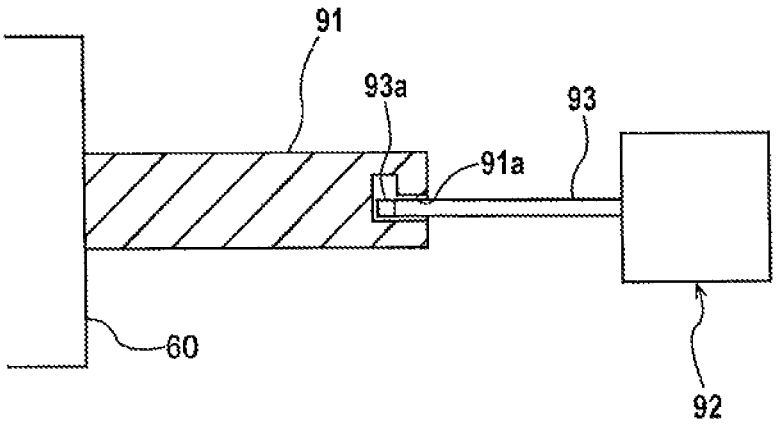
FIG. 11A is a view showing the coupling rod inserted into a mortise of the coupling block.
Figure 11B:
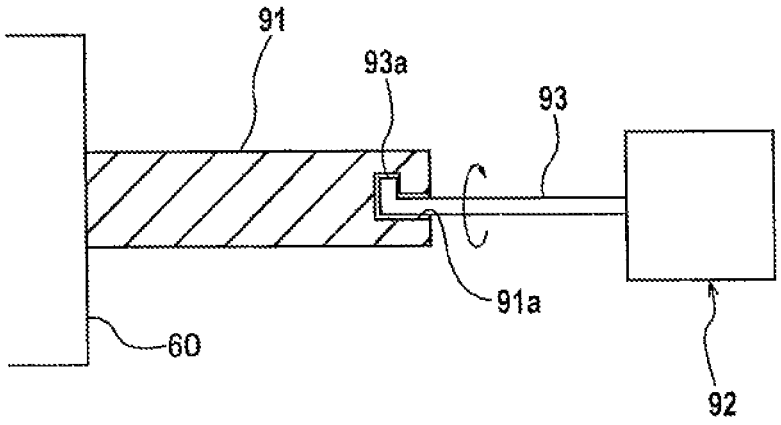
FIG. 11B is a view showing the coupling rod inserted into the mortise of the coupling block.

FIG. 11A and FIG. 11B are views each showing the coupling rod 93 inserted into the mortise 91*a* of the coupling block 91. Hereinafter, a method of coupling the conductive-block moving device 92 to the coupling block 91 will be described. The coupling rod 93 is moved toward the coupling block 91 until the L-shaped tip 93*a* of the coupling rod 93 is inserted into the mortise 91*a* of the coupling block 91 (see FIG. 11A). After the L-shaped tip 93*a* is inserted into the mortise 91*a*, the conductive-block moving device 92 rotates the coupling rod 93 through 90 degrees to thereby hook the L-shaped tip 93*a* on the coupling block 91 (see FIG. 11B). In this manner, the conductive-block moving device 92 is coupled to the coupling block 91. The coupling rod 93 can be separated from the coupling block 91 by rotating the L-shaped tip 93*a* through 90 degrees in the opposite direction.

Figure 12A:
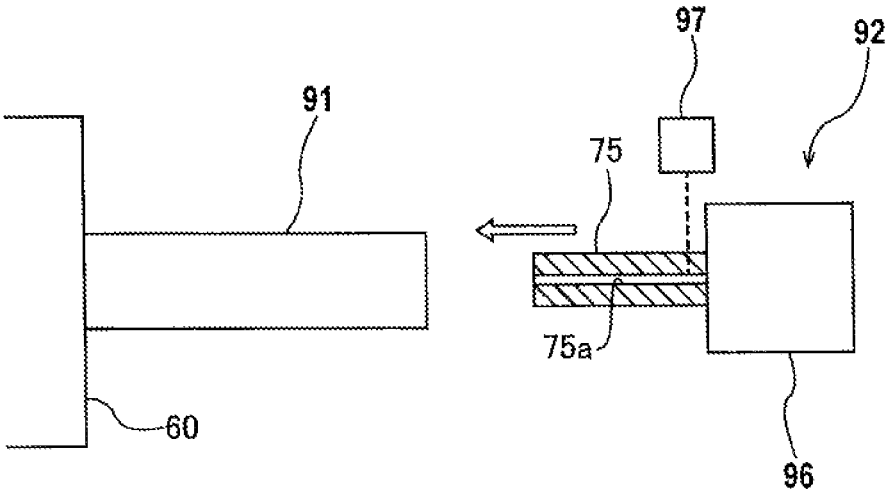
FIG. 12A is a view showing another embodiment of the conductive-block moving device.
Figure 12B:
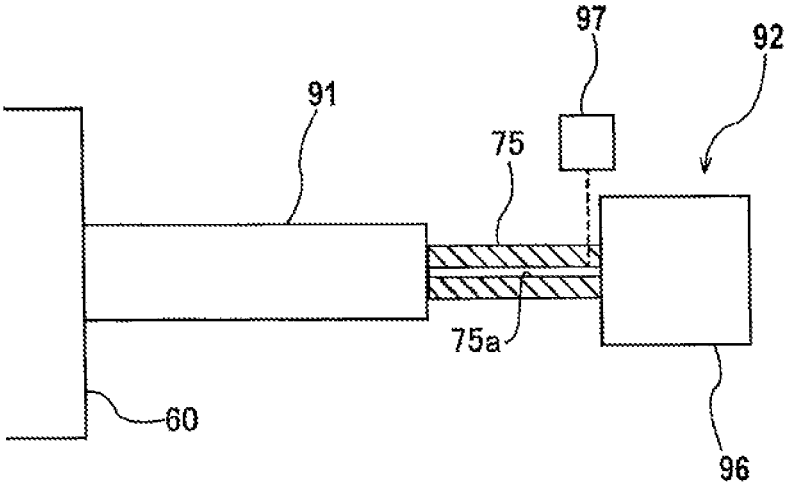
FIG. 12B is a view showing another embodiment of the conductive-block moving device.

FIG. 12A and FIG. 12B are views each showing another embodiment of the conductive-block moving device 92. The conductive-block moving device 92 includes a block holder 75, a block-holder moving device 96 configured to move the block holder 75 in directions closer to and away from the coupling block 91, and a vacuum source 97 coupled to the block holder 75. A suction hole 75*a* for holding the coupling block 91 by vacuum suction is formed in the block holder 75. The suction hole 75*a* communicates with the vacuum source 97. The block-holder moving device 96 moves the block holder 75 toward the coupling block 91 as indicated by arrow of FIG. 12A, until the block holder 75 is brought into contact with the coupling block 91 as shown in FIG. 12B. While the suction hole 75*a* is closed with the coupling block 91, a vacuum is produced in the suction hole 75*a* by operating the vacuum source 97, thereby vacuum-attracting the coupling block 91 to the block holder 75. As a result, the conductive-block moving device 92 is coupled to the coupling block 91. When the operation of the vacuum source 97 is stopped, the vacuum in the suction hole 75*a* is broken, thereby allowing the conductive-block moving device 92 to be separated from the coupling block 91.

In one embodiment, the conductive-block moving device 92 is disposed at a substrate loader (not shown) for loading a substrate, to be plated, into the substrate holder 8. After the substrate holder 8 is transported to the substrate loader, the conductive-block moving device 92 is coupled to the coupling block 91, so that the conductive-block moving device 92 can move the conductive block 60 through the coupling block 91. When the substrate holder 8, holding the substrate, is to be moved from the substrate loader, the conductive-block moving device 92 is separated from the coupling block 91. Therefore, a transport device (not shown) can transport the substrate holder 8, which holds the substrate to be plated, to the plating tank 1.

Figure 13:
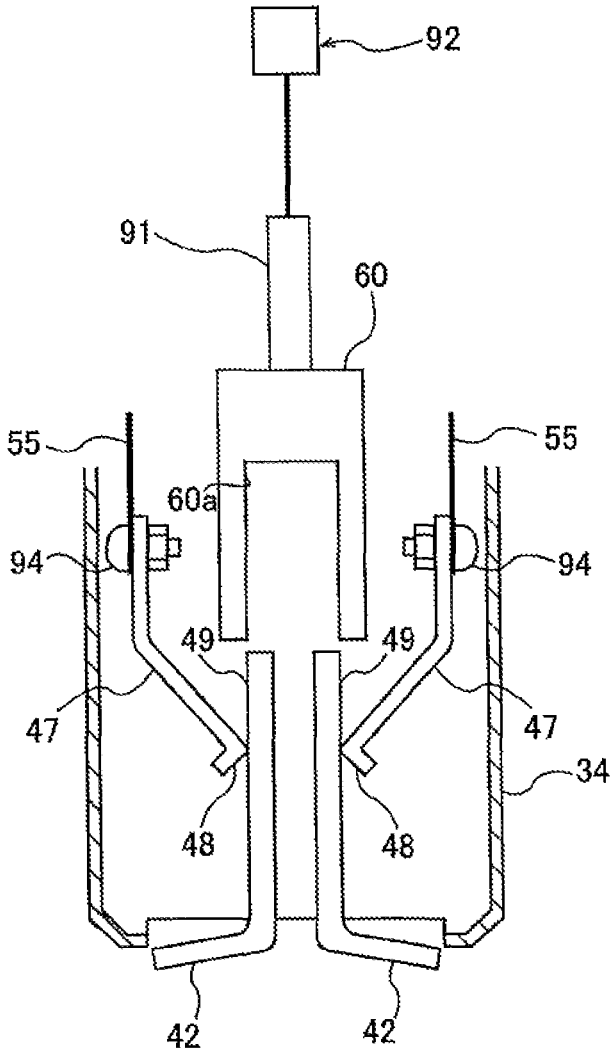
FIG. 13 is a view showing a state in which the conductive block is away from the first intermediate contacts and the second intermediate contacts.

The conductive block 60 is configured to be movable between a first position (a position shown in FIG. 7) and a second position (a position shown in FIG. 13). The first position is a position of the conductive block 60 sandwiched between the first intermediate contacts 48 and the second intermediate contacts 49. The second position is a position of the conductive block 60 located away from the first intermediate contacts 48 and the second intermediate contacts 49. More specifically, as shown in FIG. 7, the conductive block 60 is moved toward the first intermediate contacts 48 and the second intermediate contacts 49 by the conductive-block moving device 92 until the conductive block 60 is inserted between the first intermediate contacts 48 and the second intermediate contacts 49. Further, as shown in FIG. 13, the conductive block 60 is moved by the conductive-block moving device 92 until the conductive block 60 is separated from the first intermediate contacts 48 and the second intermediate contacts 49 (i.e., until the conductive block 60 is electrically disconnected from the first intermediate contacts 48 and the second intermediate contacts 49).

As shown in FIG. 7, when the conductive block 60 is sandwiched between the first intermediate contacts 48 and the second intermediate contacts 49, the conductive block 60 is in contact with all of the first intermediate contacts 48 and all of the second intermediate contacts 49. Thus, all of the first intermediate contacts 48 and all of the second intermediate contacts 49 are electrically connected to each other through the conductive block 60.

As shown in FIG. 13, when the conductive block 60 is located away from the first intermediate contacts 48 and the second intermediate contacts 49, the first intermediate contacts 48 are forced by the leaf springs 47 serving as the biasing device, until the first intermediate contacts 48 are brought into contact with the second intermediate contacts 49, respectively. In this state, the twelve first intermediate contacts 48 are electrically connected to the twelve second intermediate contacts 49, respectively. In other words, all of the first intermediate contacts 48 are not electrically connected to each other, and all of the second intermediate contacts 49 are not electrically connected to each other, as well.

The conductive block 60 is brought into sliding contact with the first intermediate contacts 48 and the second intermediate contacts 49 when the conductive block 60 is inserted between the first intermediate contacts 48 and the second intermediate contacts 49. Therefore, even if a foreign matter is attached to the surface of the conductive block 60, the first intermediate contacts 48 and the second intermediate contacts 49 can scrape the foreign matter off the surface of the conductive block 60.

Figure 14:
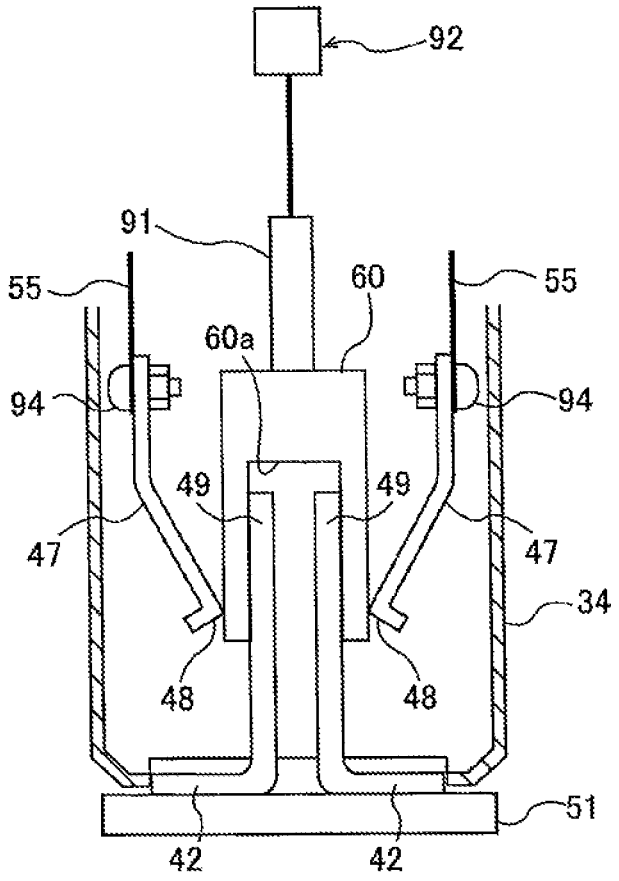
FIG. 14 is a view showing a part of the substrate holder when the outer contacts are pressed against a feeding terminal.

As shown in FIG. 14, when the holder hanger 34 is supported by the holder support member 50 (see FIG. 6), the outer contacts 42 are pressed against the feeding terminal 51 by the own weight of the substrate holder 8, so that the outer contacts 42 are electrically connected to the feeding terminal 51. The electric current uniformly flows through the outer contacts 42, the second intermediate contacts 49, the conductive block 60, the first intermediate contacts 48, the wires 55, and the inner contacts 45 to the substrate W, so that the surface of the substrate W is plated.

If a surface of the feeding terminal 51 is deteriorated, or a foreign matter is attached to the surface of the feeding terminal 51, an electrical resistance between the feeding terminal 51 and one or more of the outer contacts 42 may be changed. In such a case also, since all of the first intermediate contacts 48 and all of the second intermediate contacts 49 are electrically connected through the conductive block 60, a variation in the electrical resistance between the outer contacts 42 can be eliminated. Therefore, a uniform current is passed through the conductive block 60 to the inner contacts 45. As a result, a metal film with a uniform thickness can be formed on the surface of the substrate W.

Figure 15:
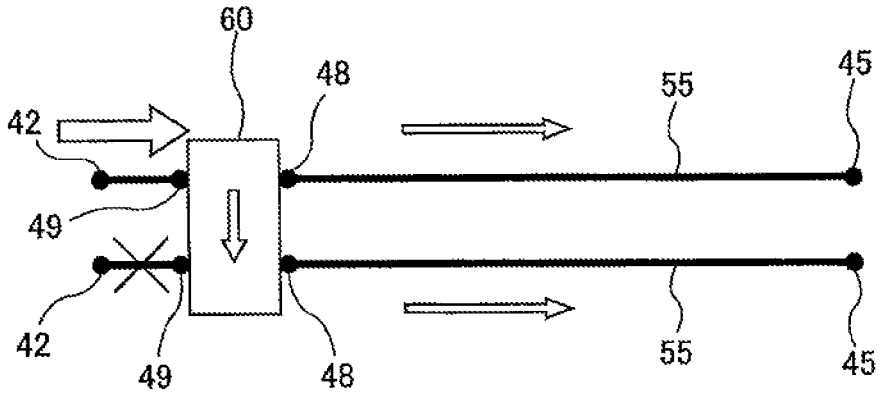
FIG. 15 is a schematic view illustrating electric current when the conductive block is sandwiched between the first intermediate contacts and the second intermediate contacts.

FIG. 15 is a schematic view illustrating the electric current when the conductive block 60 is sandwiched between the first intermediate contacts 48 and the second intermediate contacts 49. As shown in FIG. 15, since the conductive block 60 exists between the first intermediate contacts 48 and the second intermediate contacts 49, the first intermediate contacts 48 are coupled to the second intermediate contacts 49 through the conductive block 60. Therefore, the electric current, which is to be passed from the outer contacts 42 to the inner contacts 45, flows through the outer contacts 42, the second intermediate contacts 49, the conductive block 60, the first intermediate contacts 48, the wires 55, and the inner contacts 45 in this order. The conductive block 60 has a cross-sectional area which is large enough to provide the same electric potential in the conductive block 60. In the above-described current paths, the electric current necessarily flows through two contacts at which contact resistances can exist, i.e., the second intermediate contacts 49 and the first intermediate contacts 48. Therefore, even if there is a poor contact between one or more of the outer contacts 42 and the feeding terminal 51, the electric current flows uniformly in all of the wires 55, compared with a below-described comparative example.

Figure 16:
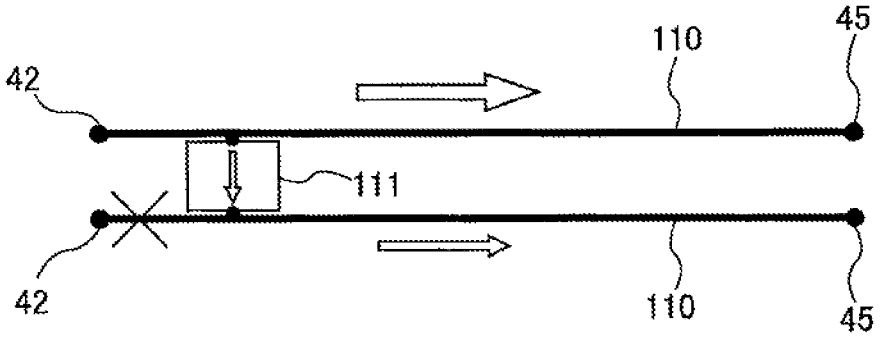
FIG. 16 is a schematic view showing a comparative example demonstrating current paths different from the embodiment shown in FIG. 15.

FIG. 16 is a schematic view showing a comparative example demonstrating current paths different from the embodiment shown in FIG. 15. In this comparative example, outer contacts 42 are coupled to inner contacts 45 through wires 110, and the first intermediate contacts 48 and the second intermediate contacts 49 of the above embodiment are not provided. A conductor 111 is arranged between the wires 110, so that the wires 110 are electrically connected to each other through the conductor 111. In this case, since a contact resistance exists between each wire 110 and the conductor 111, if a poor contact exists between one of the outer contacts 42 and the feeding terminal 51, the electric current is likely to flow to the wire 110 in a good contact state. As a result, a non-uniform electric current flows through the wires 110.

As can be seen from a contrast between FIG. 15 and FIG. 16, according to the embodiment, the conductive block 60 is inserted between the first intermediate contacts 48 and the second intermediate contacts 49. Therefore, if a contact resistance between each first intermediate contact 48 and the conductive block 60, a contact resistance between each second intermediate contact 49 and the conductive block 60, and the electrical resistance of the conductive block 60 are negligibly small, values of the electrical resistances in the electric paths from the outer contacts 42 to the inner contacts 45 are the same as each other. Therefore, the substrate holder 8 according to the embodiment can supply the uniform current to the substrate W.

If there are variations in the contact resistance between the conductive block 60 and the first intermediate contacts 48, and between the inner contacts 45 and the periphery of the substrate W, a variation in the electric current flowing in each electric path also occurs. Thus, in order to reduce such a variation in the electric current, the wires 55 may preferably be made of metal which has a higher electrical resistance than that of copper (e.g., copper nickel alloy). Such wires can suppress the above-described influence of the contact resistance on the variation in the electric current flowing in the wires 55.

As described above, the variation in the electrical resistance of the inner contacts 45 and/or a conductive film of the substrate W has an adverse influence on the plating of the substrate W. Thus, it is desirable to measure the electrical resistance between the outer contacts 42 before starting the plating of the substrate W.

Figure 17:
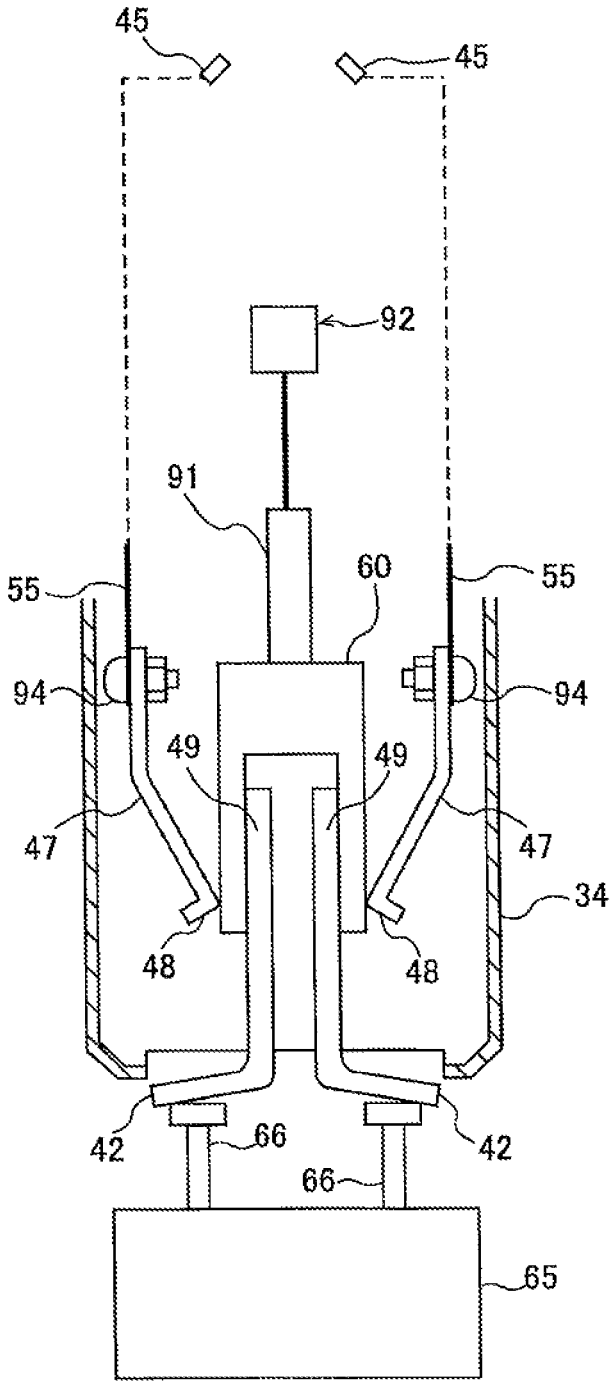
FIG. 17 is a view showing a resistance-measuring device and a part of the substrate holder when a first measuring is being performed.

Two types of measuring of the electrical resistance between the outer contacts 42 are performed. A first measuring is performed without holding the substrate W with the substrate holder 8. FIG. 17 shows a resistance-measuring device 65 and a part of the substrate holder 8 when the first measuring is being performed. The resistance-measuring device 65 has probes 66. Although not shown in the drawing, the number of probes 66 is the same as the number of outer contacts 42 (twelve probes 66 are provided in this embodiment). When the conductive block 60 is sandwiched between the first intermediate contacts 48 and the second intermediate contacts 49, the probes 66 of the resistance-measuring device 65 are brought into contact with the outer contacts 42, and the electrical resistance between the outer contacts 42 is then measured.

If a foreign matter exists between the second intermediate contact 49 and the conductive block 60, the electrical resistance may change. The above-described first measuring is performed in order to check the connection between the second intermediate contacts 49 and the conductive block 60. Specifically, as described above, the electrical resistance is measured when the substrate holder 8 is not holding a substrate and when the conductive block 60 is in contact with the second intermediate contacts 49. From results of this first measuring, it is possible to check whether or not the second intermediate contacts 49 and the conductive block 60 are properly connected.

Figure 18:
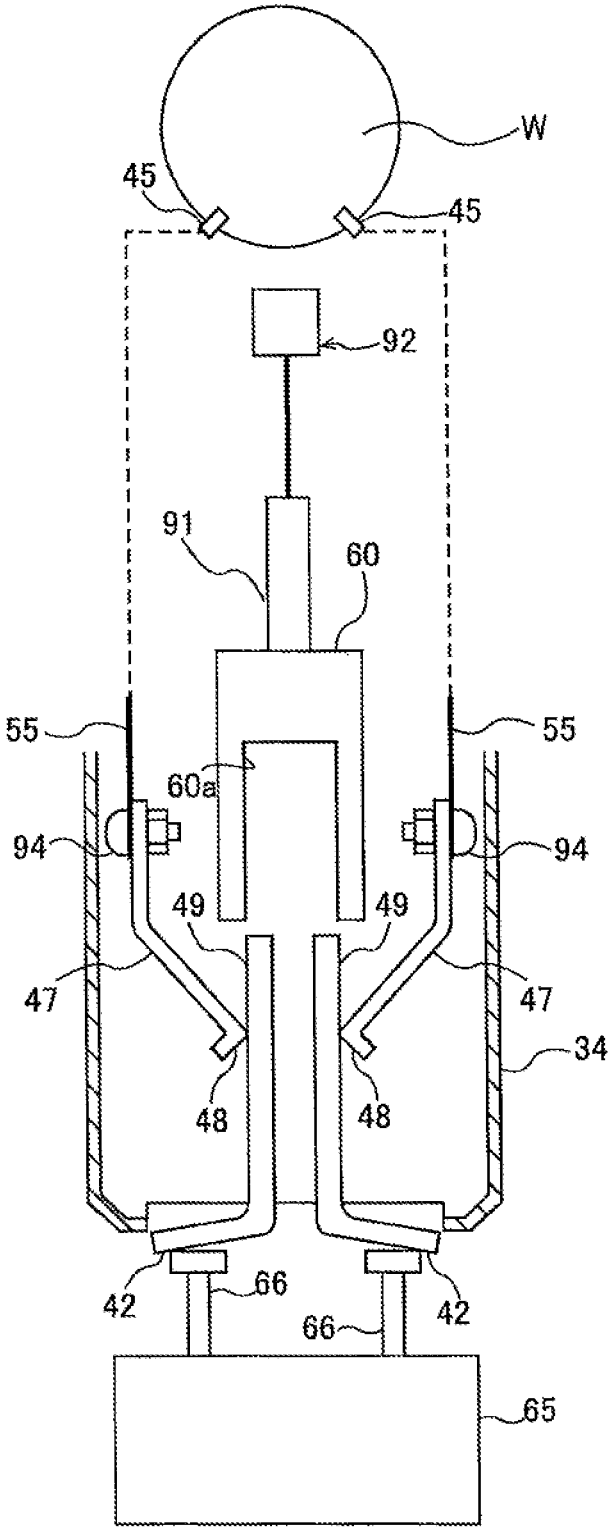
FIG. 18 is a view showing the resistance-measuring device and a part of the substrate holder when a second measuring is being performed.

A second measuring is performed when the substrate W is held by the substrate holder 8 and when the conductive block 60 is located away from the first intermediate contacts 48 and the second intermediate contacts 49. FIG. 18 is a view showing the resistance-measuring device 65 and a part of the substrate holder 8 when the second measuring is being performed. The resistance-measuring device 65 measures the electrical resistance between the outer contacts 42 when the first intermediate contacts 48 and the second intermediate contacts 49 are in contact with each other. As described above, since the second measuring is performed when the substrate W is held by the substrate holder 8, it is possible to detect whether or not there is a defect in the inner contacts 45 and/or the conductive film of the substrate W.

Measuring of the electrical resistance between the outer contacts 42 by the resistance-measuring device 65 is automatically performed at the substrate loader (not shown) for loading the substrate W into the substrate holder 8. While the two types of measuring of the electrical resistance between the outer contacts 42 are performed in this embodiment, only the second measuring may be performed without performing the first measuring.

Figure 19:
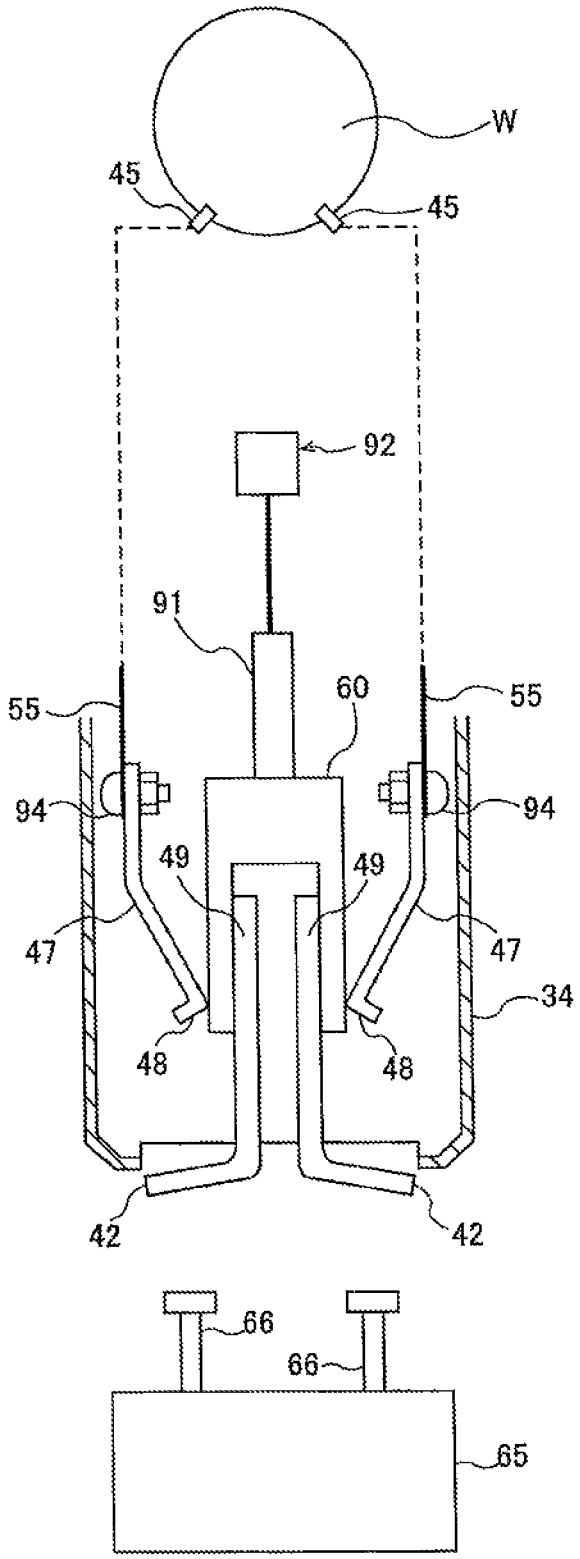
FIG. 19 is a view showing a part of the substrate after measuring of an electrical resistance and just before plating of the substrate.

After the electrical resistance is measured, as shown in FIG. 19, the resistance-measuring device 65 is moved away from the outer contacts 42, and the conductive block 60 is inserted between the first intermediate contacts 48 and the second intermediate contacts 49 again, whereby the first intermediate contacts 48 and the second intermediate contacts 49 are electrically connected through the conductive block 60. In this state, the substrate holder 8 is transported from the substrate loader to the plating tank 1 by the transport device (not shown), and the substrate W is then plated in the plating tank 1.

Figure 20:
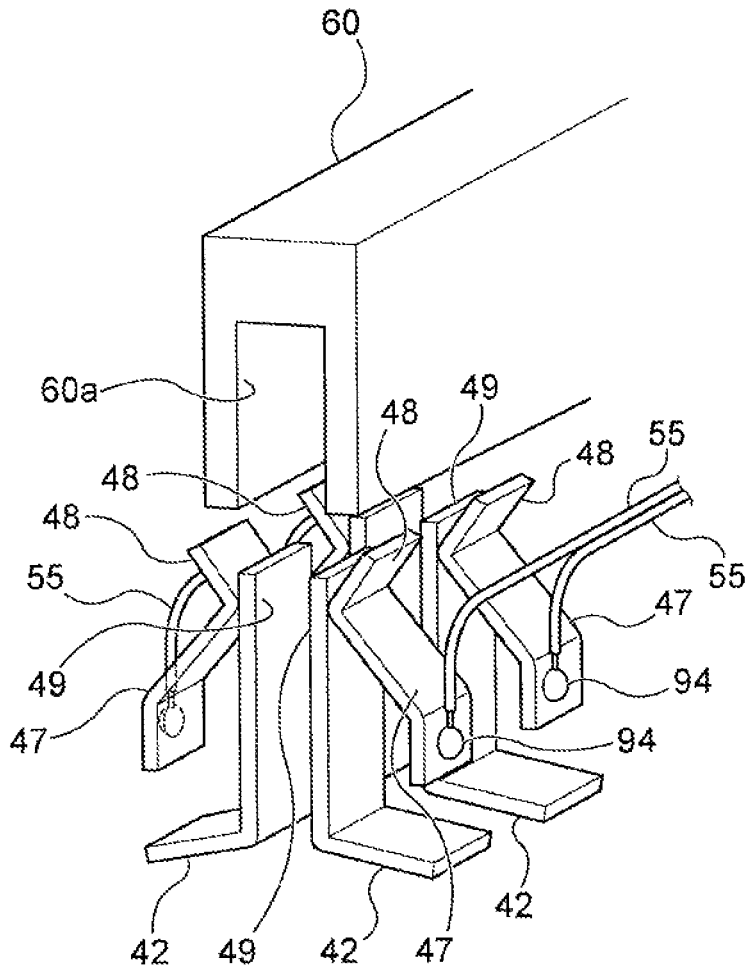
FIG. 20 is a perspective view showing an example of a modification of the substrate holder.

FIG. 20 is a perspective view showing an example of a modification of the substrate holder 8, and shows in a state in which the conductive block 60 is away from the first intermediate contacts 48 and the second intermediate contacts 49. In the above-described example shown in FIG. 8, the first intermediate contacts 48 are located below connecting positions between the first intermediate contacts 48 and the wires 55. In the example shown in FIG. 20, the first intermediate contacts 48 are located above the connecting positions between the first intermediate contacts 48 and the wires 55.

Figure 21:
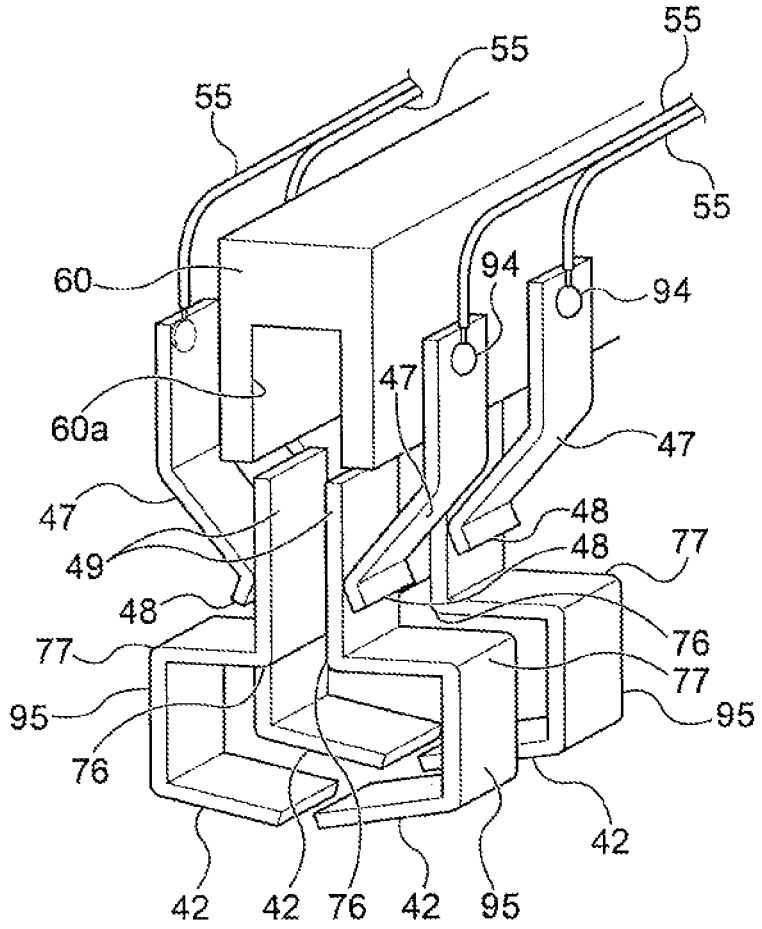
FIG. 21 is a perspective view showing another example of a modification of the substrate holder.

FIG. 21 is a perspective view showing another example of a modification of the substrate holder 8. In this example shown in FIG. 21, the outer contacts 42 are coupled to the second intermediate contacts 49 through conductive elements 95, respectively. Each of the conductive elements 95 is in a form of a leaf spring which has a plurality of bent portions 76, 77. The outer contact 42, the conductive element 95, and the second intermediate contact 49 are integrally formed from the same material.

Figure 22:
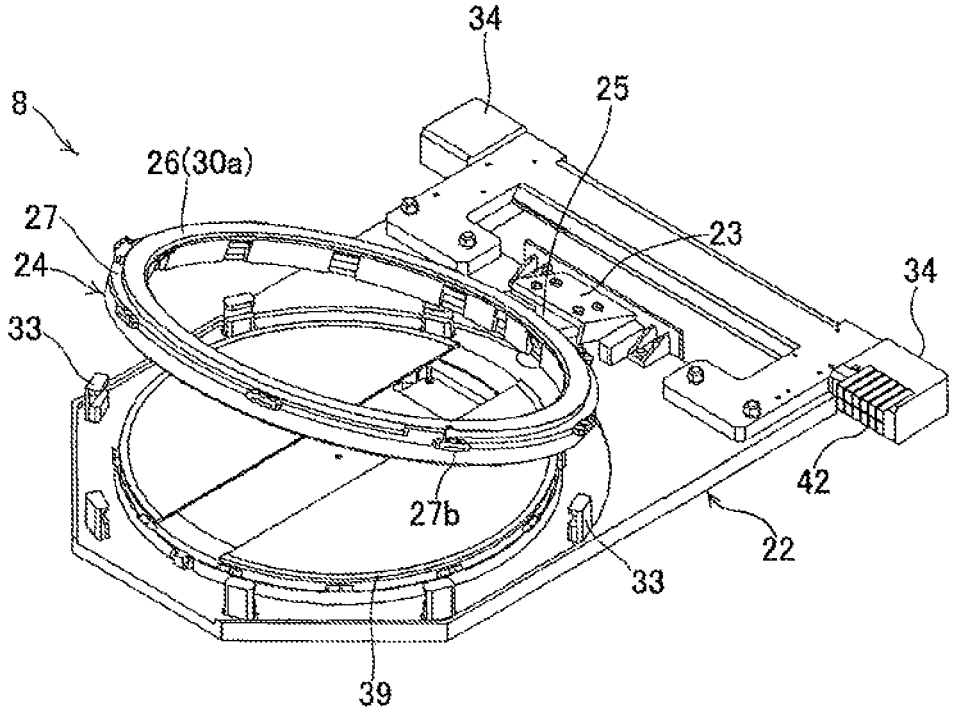
FIG. 22 is a perspective view showing another embodiment of the substrate holder.
Figure 24:
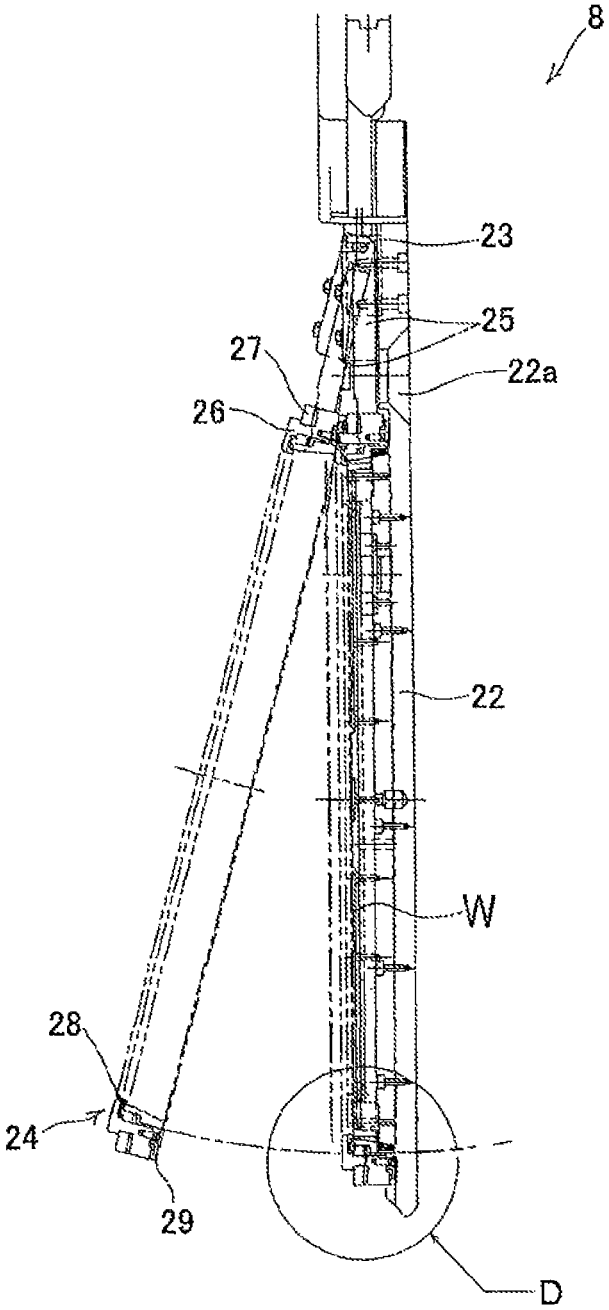
FIG. 24 is a right-side view of the substrate holder shown in FIG. 22.
Figure 25:
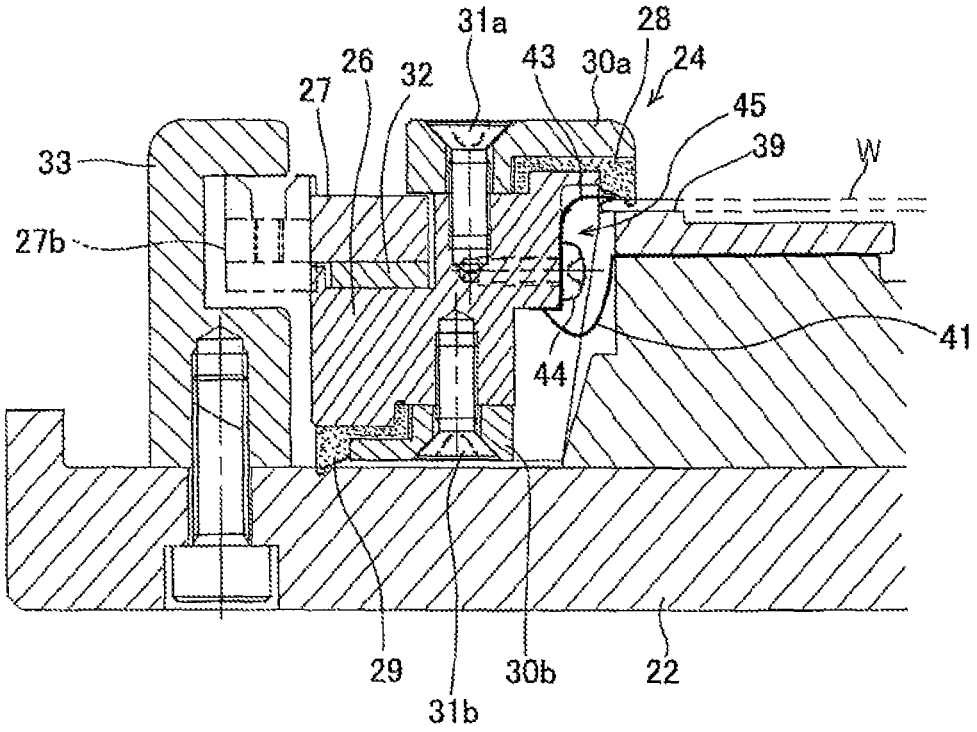
FIG. 25 is an enlarged view showing an encircled area indicated by symbol D shown in FIG. 24.

Next, another embodiment will be described with reference to FIG. 22 through FIG. 39. Structures and operations of this embodiment, which will not be described particularly, are the same as those of the embodiment that has been described with reference to FIG. 1 through FIG. 6, and their repetitive descriptions are omitted. FIG. 22 is a perspective view showing another embodiment of the substrate holder 8, FIG. 23 is a plan view of the substrate holder 8 shown in FIG. 22, FIG. 24 is a right-side view of the substrate holder 8 shown in FIG. 22, and FIG. 25 is an enlarged view showing an encircled area indicated by symbol D shown in FIG. 24.

Figure 23:
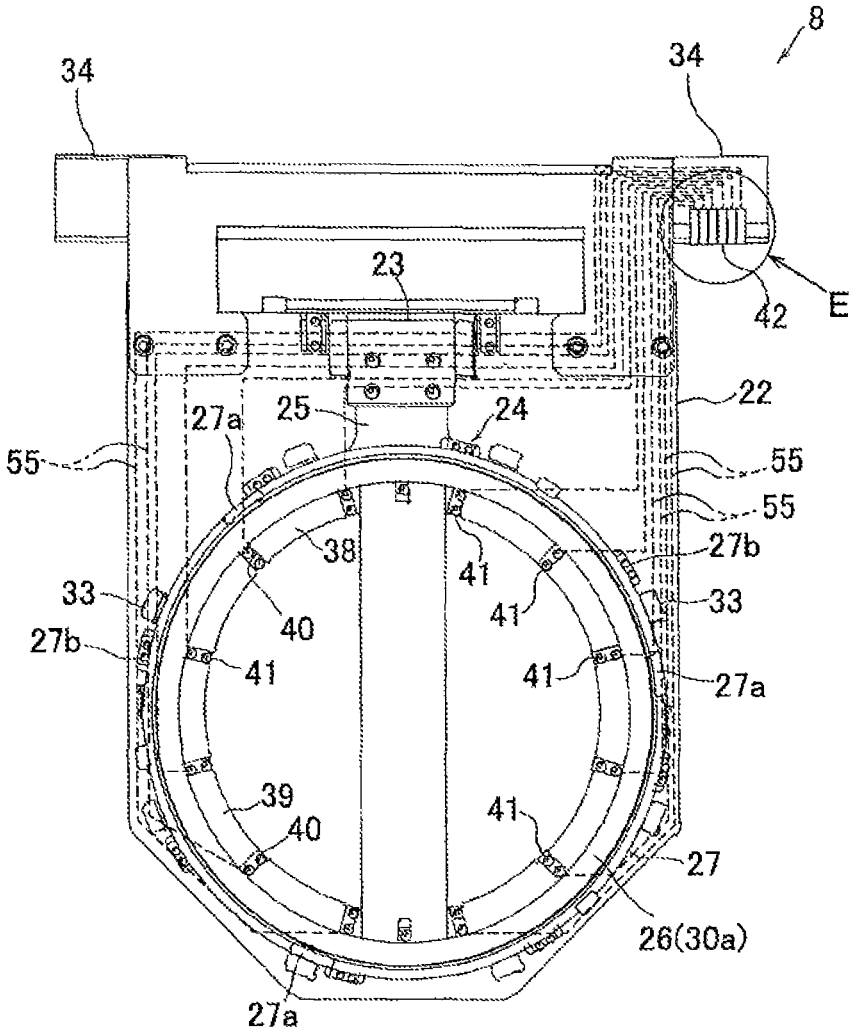
FIG. 23 is a plan view of the substrate holder shown in FIG. 22.

As shown in FIG. 22 and FIG. 23, a plurality of outer contacts 42 are mounted to one of two holder hangers 34. While six outer contacts 42 are shown in FIG. 23, other six outer contacts 42 are disposed behind the outer contacts 42 shown in FIG. 23, as can be seen from FIG. 22. Therefore, a total of twelve outer contacts 42 are provided. The twelve outer contacts 42 are coupled to conductive members 41 of twelve inner contacts 45 through twelve wires 55, respectively. The wires 55 are disposed in the substrate holder 8. The twelve wires 55 have the same length as each other.

There is a slight variation of several ma in electrical resistance in the wires 55. In order to reduce the influence of such a variation in the electrical resistance, the wires 55 may preferably be made of high resistance material, such as copper nickel alloy. The variation in the electrical resistance between the wires 55 is extremely small, compared with a electrical resistance value of the high resistance material. Therefore, by using the high resistance material, the variation in the electrical resistance between the wires 55 can be small relatively. As a result, the electrical resistances of the wires 55 become approximately the same.

Figure 26:
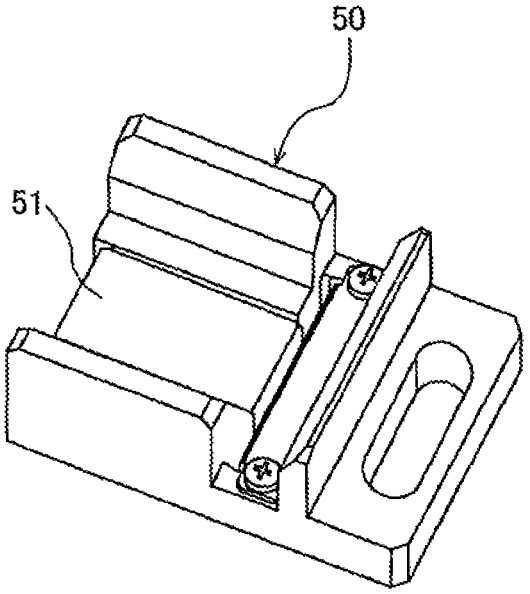
FIG. 26 is a view showing a holder support member secured to a surrounding wall of a plating tank.

The substrate holder 8 is suspended in the plating tank 1, with the holder hangers 34 placed on the surrounding wall of the plating tank 1 (see FIG. 1). FIG. 26 is a view showing holder support member 50 secured to the surrounding wall of the plating tank 1. The holder support member 50 for supporting the holder hanger 34, provided with the outer contacts 42, is secured to the surrounding wall of the plating tank 1. Feeding terminal 51, which is coupled to the power source 18 (see FIG. 1), is provided in the holder support member 50. When the substrate holder 8 is disposed in the plating tank 1, the outer contacts 42 of the substrate holder 8 are brought into contact with the feeding terminal 51.

Figure 27:
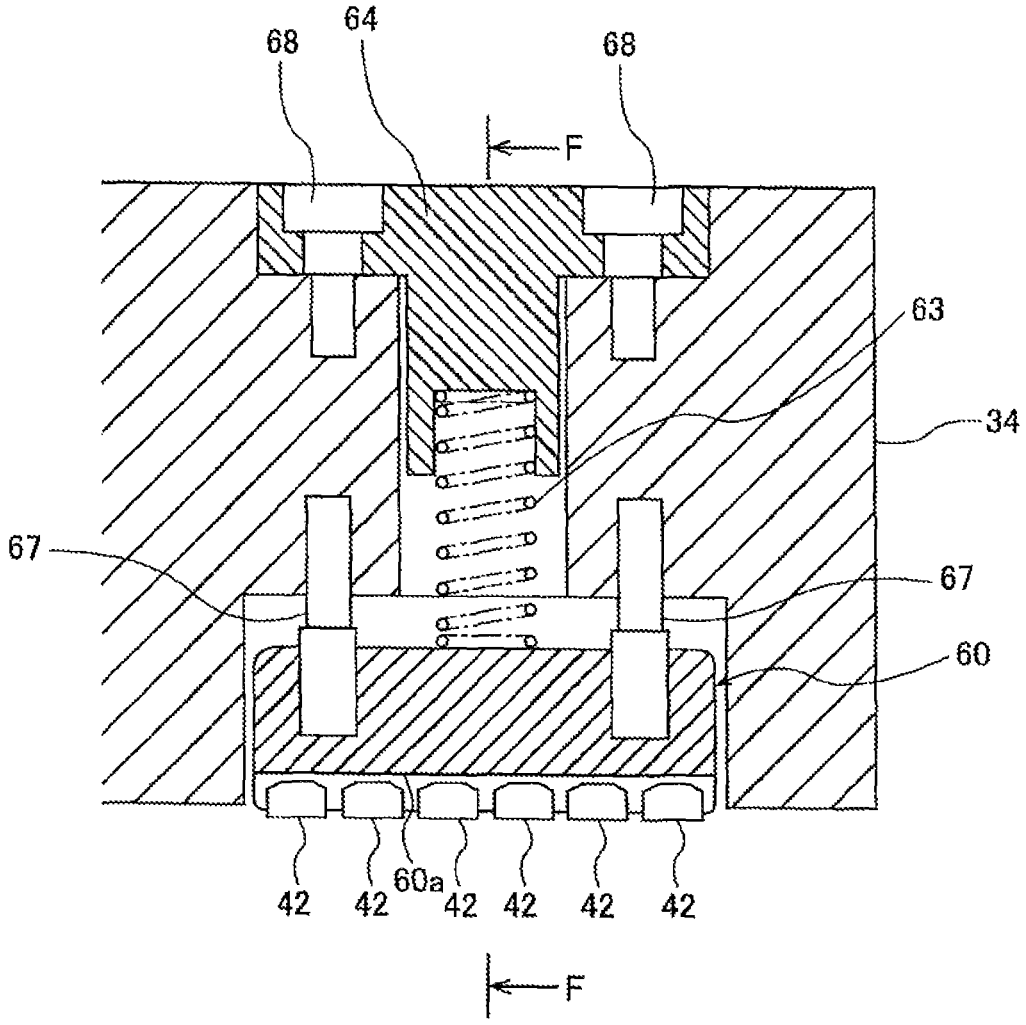
FIG. 27 is an enlarged view showing an encircled area indicated by symbol E shown in FIG. 23.

FIG. 27 is an enlarged view showing an encircled area indicated by symbol E shown in FIG. 23. The substrate holder 8 includes a conductive block 60 made of conductive material, and a spring 63 as a biasing member for pressing the conductive block 60 against the outer contacts 42. The conductive block 60 may be made of copper plated with gold or platinum. The conductive block 60 is housed in the holder hanger 34, and is not exposed to the outside. This arrangement can prevent a foreign matter from being attached to a surface of the conductive block 60. In this embodiment, the spring 63 serving as the biasing member is a coil spring. Another device may be used as the biasing member so long as the biasing member can press the conductive block 60 against the outer contacts 42.

The spring 63 is arranged between the conductive block 60 and a spring stopper 64 which is disposed above the conductive block 60. The spring 63 is configured to bias or force the conductive block 60 toward the outer contacts 42. The spring stopper 64 is secured to the holder hanger 34 by fastening tools 68, such as screws. The holder hanger 34 and the conductive block 60 are coupled to each other by a plurality of linear guides 67. These linear guides 67 are guide devices for guiding movement of the conductive block 60 in vertical direction. The linear guides 67 extend vertically, so that the conductive block 60 moves up and down along a longitudinal direction of the linear guides 67.

Figure 28A:
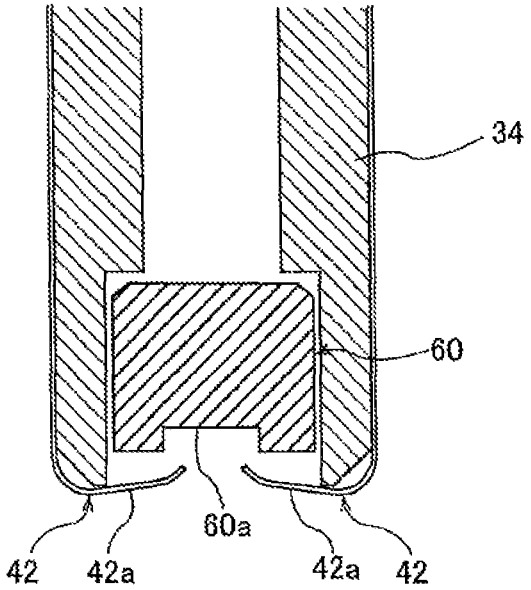
FIG. 28A is a cross-sectional view taken along line F-F of FIG. 27.
Figure 28B:
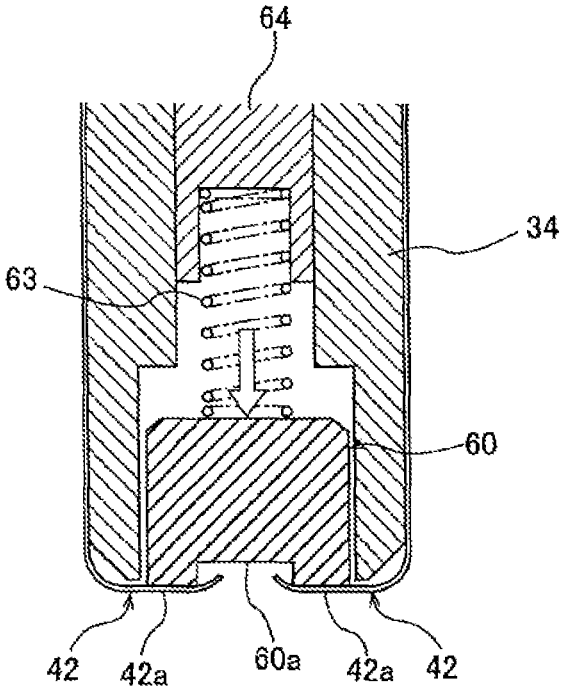
FIG. 28B is a cross-sectional view taken along line F-F of FIG. 27.

FIG. 28A and FIG. 28B are cross-sectional views taken along line F-F of FIG. 27. More specifically, FIG. 28A shows the conductive block 60 before the spring stopper 64 and the spring 63 are attached to the substrate holder 8, and FIG. 28B shows the conductive block 60 after the spring stopper 64 and the spring 63 are attached to the substrate holder 8.

Each outer contact 42 has elasticity in its entirety, and functions as a leaf spring. As shown in FIG. 28A, when the spring stopper 64 and the spring 63 are not attached to the substrate holder 8, the outer contacts 42 are bent upwardly toward the conductive block 60. When the spring stopper 64 and the spring 63 are attached to the substrate holder 8, as shown in FIG. 28B, the conductive block 60 is pressed against the outer contacts 42 by the spring 63, thereby causing elastic deformation of all the outer contacts 42. As a result, the conductive block 60 is in contact with all of the outer contacts 42, and the outer contacts 42 are electrically connected to each other through the conductive block 60.

The outer contacts 42 have contact surfaces 42*a*, respectively, which are to be brought into contact with the feeding terminal 51. The conductive block 60 is located in back of the contact surfaces 42*a* of the outer contacts 42. The outer contacts 42 are electrically connected to the inner contacts 45 through the wires 55 (see FIG. 23), respectively. Specifically, twelve outer contacts 42 are coupled to twelve inner contacts 45, respectively.

A groove 60*a*, which extends along an arrangement direction of the outer contacts 42, is formed in a lower surface of the conductive block 60. Tips of the outer contacts 42 are bent upwardly. These tips of the outer contacts 42 are located in the groove 60*a*. As shown in FIG. 27, the conductive block 60 extends along the arrangement direction of the outer contacts 42, and is in contact with back-side surfaces of all of the outer contacts 42 which are opposite sides from the contact surfaces 42*a*.

Figure 29:
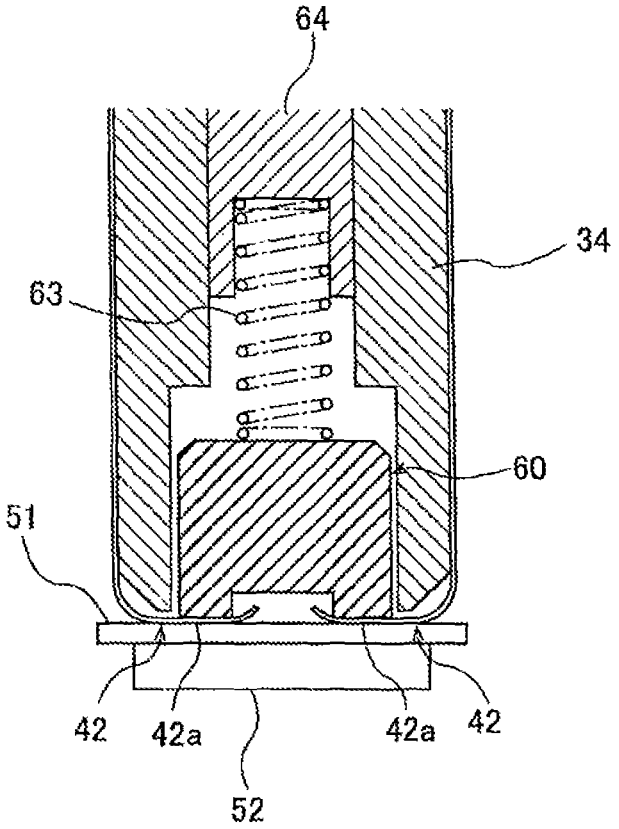
FIG. 29 is a cross-sectional view showing a part of the substrate holder when the outer contacts are pressed against the feeding terminal.

When the holder hanger 34 is supported by the holder support member 50 (see FIG. 26), as shown in FIG. 29, the contact surfaces 42*a* of the outer contacts 42 are pressed against the feeding terminal 51 by the own weight of the substrate holder 8, whereby the outer contacts 42 are electrically connected to the feeding terminal 51. Since all of the outer contacts 42 are electrically connected to each other through the conductive block 60, all of the outer contacts 42 are electrically connected to the feeding terminal 51. The electric current flows through the outer contacts 42 and the inner contacts 45 to the substrate W, so that the surface of the substrate W is plated.

If a surface of the feeding terminal 51 is deteriorated, or a foreign matter is attached to the surface of the feeding terminal 51, an electrical resistance between the feeding terminal 51 and one or more of the outer contacts 42 may be changed. As a result, a non-uniform electric current may be passed to the inner contacts 45. Even in such a case, since all of the outer contacts 42 are electrically connected to each other through the conductive block 60, a variation in the electrical resistance between the outer contacts 42 can be eliminated. Therefore, a uniform electric current is passed through the outer contacts 42 to the inner contacts 45. As a result, a metal film with a uniform thickness can be formed on the surface of the substrate W.

During plating of the substrate W, if the substrate holder 8 swings due to the motion of the paddle 16, the outer contacts 42 may be intermittently connected to the feeding terminal 51. Thus, in order to prevent such intermittent connection, the conductive block 60 may be made of magnetic material, and the holder support member 50 may have a magnet 52 (see FIG. 29). The magnetic material to be used may be stainless steel, such as SUS430 or SUS440. The magnet 52 is disposed on a lower surface of the feeding terminal 51. With such configuration, the substrate holder 8 is firmly held on the plating tank 1 by a magnetic force acting between the conductive block 60 and the magnet 52, whereby the contact between the outer contacts 42 and the feeding terminal 51 is ensured.

Figure 30:
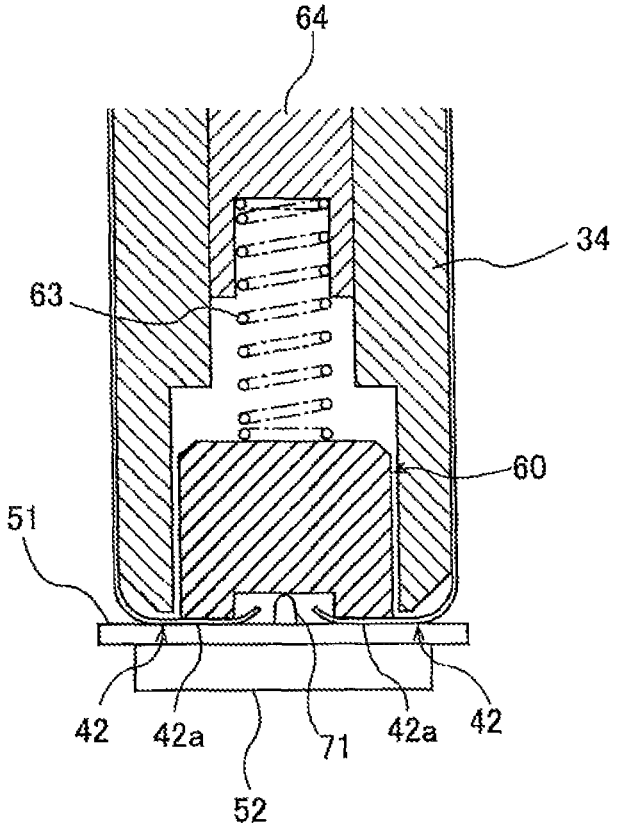
FIG. 30 is a view showing an auxiliary terminal provided on the feeding terminal.

As shown in FIG. 30, an auxiliary terminal 71, which projects toward the conductive block 60, may be provided on the feeding terminal 51. This auxiliary terminal 71 is made of conductive material. When the contact surfaces 42*a* of the outer contacts 42 are pressed against the feeding terminal 51, the auxiliary terminal 71 is brought into contact with the conductive block 60. The electric current flows to the outer contacts 42 through the contact between the contact surfaces 42*a* and the feeding terminal 51, while the electric current flows through the auxiliary terminal 71 and the conductive block 60 to the outer contacts 42. Therefore, the auxiliary terminal 71 can ensure the supply of the electric current from the feeding terminal 51 to the outer contacts 42. Only the auxiliary terminal 71 may be in contact with the conductive block 60 by extending the auxiliary terminal 71 upwardly.

Figure 31:
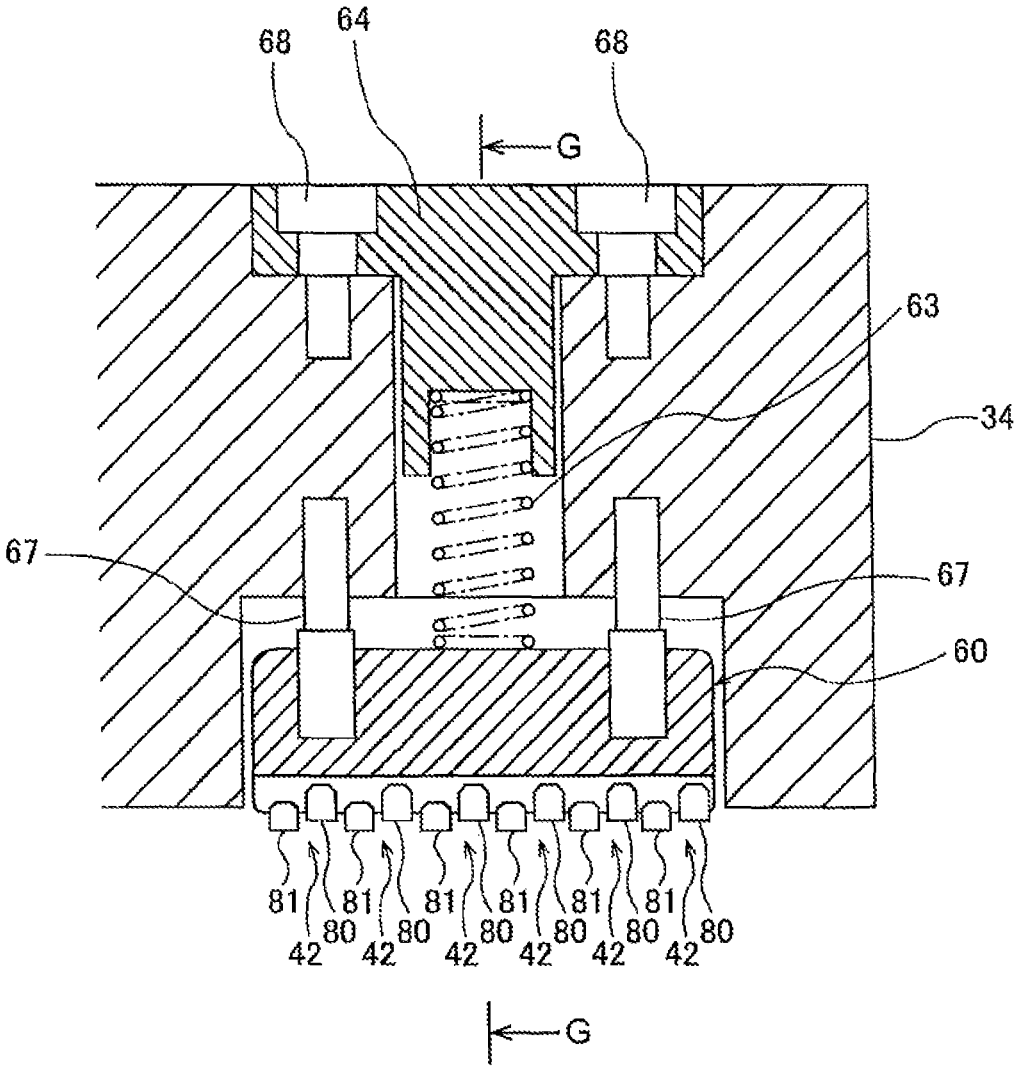
FIG. 31 is an enlarged cross-sectional view showing an example of a modification of the outer contacts.
Figure 32:
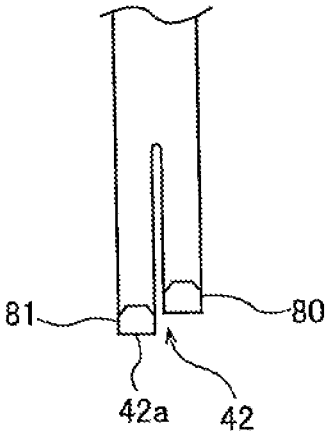
FIG. 32 is a front view of the outer contacts shown in FIG. 31.
Figure 33A:
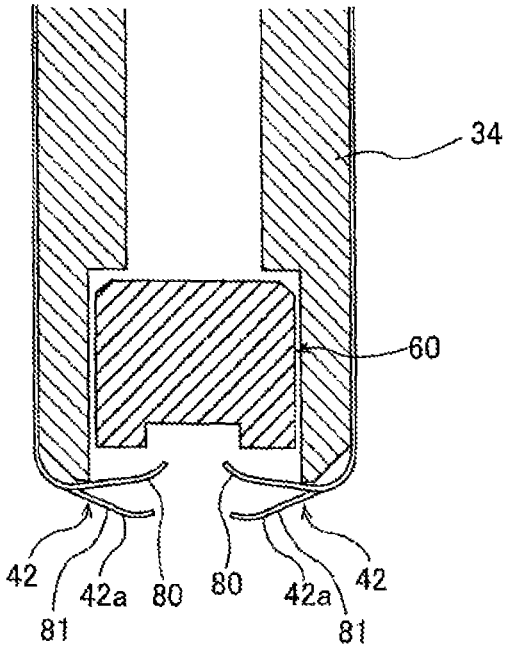
FIG. 33A is a cross-sectional view taken along line G-G of FIG. 31.
Figure 33B:
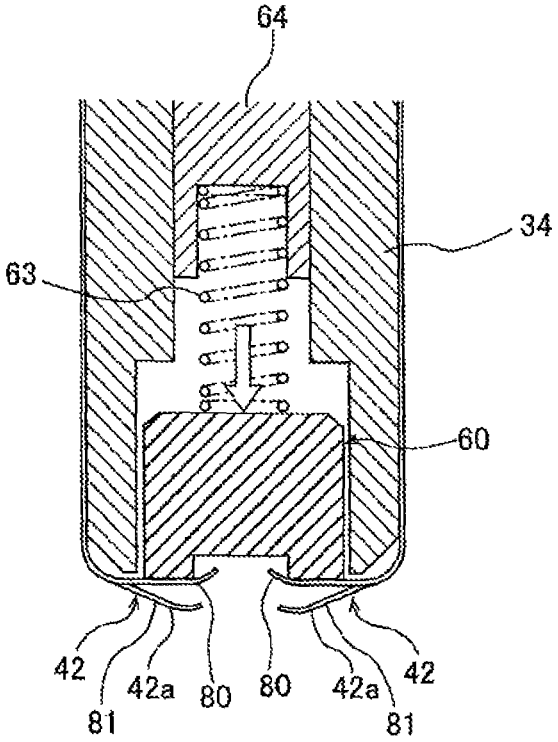
FIG. 33B is a cross-sectional view taken along line G-G of FIG. 31.

FIG. 31 is an enlarged cross-sectional view showing an example of a modification of the outer contacts 42. FIG. 32 is a front view of the outer contacts 42 shown in FIG. 31. FIG. 33A and FIG. 33B are cross-sectional views taken along line G-G of FIG. 31. More specifically, FIG. 33A shows the conductive block 60 before the spring stopper 64 and the spring 63 are attached to the substrate holder 8, and FIG. 33B shows the conductive block 60 after the spring stopper 64 and the spring 63 are attached to the substrate holder 8.

Each of the outer contacts 42 includes a first contact 80 which is in contact with the conductive block 60, and a second contact 81 which extends in a direction away from the conductive block 60. While six contacts 80 and six contacts 81 are shown in FIG. 31, other contacts 80, 81 of the same number are provided at the opposite side from the contacts 80, 81 shown in FIG. 31. Specifically, twelve outer contacts 42 are constituted by twelve first contacts 80 and twelve second contacts 81. As shown in FIG. 32, the first contact 80 and the second contact 81, which constitutes each outer contact 42, are electrically connected to each other.

Each outer contact 42 has elasticity in its entirety, and functions as a leaf spring. As shown in FIG. 33A, when the spring stopper 64 and the spring 63 are not attached to the substrate holder 8, the first contacts 80 are bent upwardly toward the conductive block 60. When the spring stopper 64 and the spring 63 are attached to the substrate holder 8, as shown in FIG. 33B, the conductive block 60 is pressed against the first contacts 80 by the spring 63, thereby causing elastic deformation of all of the first contacts 80. As a result, the conductive block 60 is in contact with all of the first contacts 80, and these first contacts 80 are electrically connected to each other through the conductive block 60.

Figure 34:
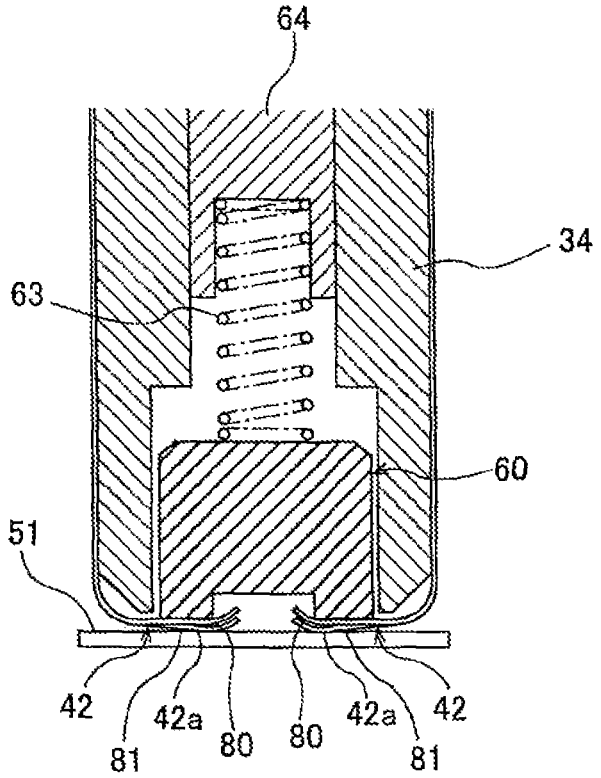
FIG. 34 is a cross-sectional view showing a part of the substrate holder when the outer contacts are pressed against the feeding terminal.

The conductive block 60 is pressed against the first contacts 80, while the second contacts 81 are located away from the conductive block 60. Lower surfaces of the second contacts 81 provide contact surfaces 42*a* which are to be brought into contact with the feeding terminal 51. When the holder hanger 34 is supported by the holder support member 50 (see FIG. 26), as shown in FIG. 34, the second contacts 81 are forced to elastically deform by the own weight of the substrate holder 8. The contact surfaces 42*a* of all of the second contacts 81 are pressed against the feeding terminal 51, so that the outer contacts 42 are electrically connected to the feeding terminal 51. Further, lower surfaces of the first contacts 80 may also be brought into contact with the feeding terminal 51.

Since the second contacts 81 can deform independently of each other, even if there exists a variation in distance between the feeding terminal 51 and the outer contacts 42, all of the second contacts 81 can be brought into contact with the feeding terminal 51. Further, even if one or more of the second contacts 81 cannot be brought into contact with the feeding terminal 51 due to some cause, such as the presence of a foreign matter, the electric current can be passed to all of the inner contacts 45, because all of the first contacts 80 are electrically connected to each other through the conductive block 60.

Figure 35:
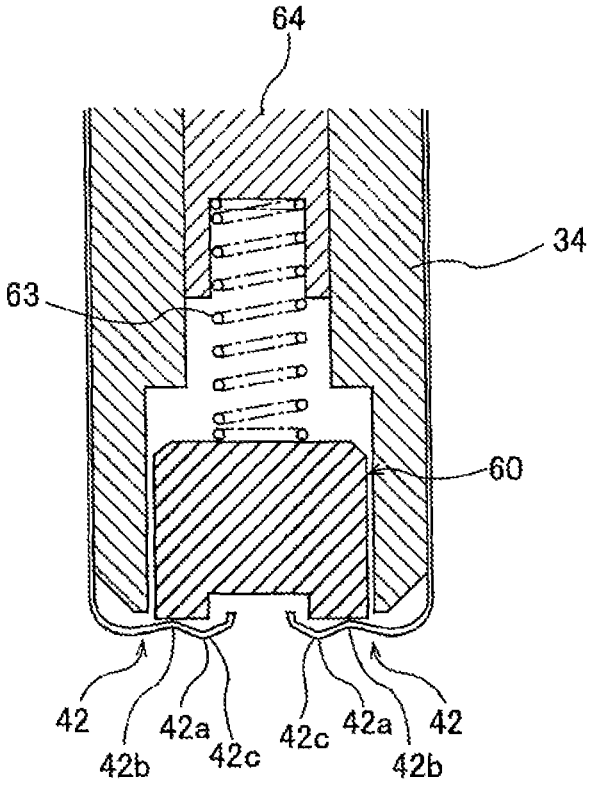
FIG. 35 is a view showing another example of a modification of the outer contacts.

FIG. 35 is a view showing another example of a modification of the outer contacts 42. As shown in FIG. 35, each of the outer contacts 42 has a first projecting portion 42*b* which is in contact with the conductive block 60, and a second projecting portion 42*c* which projects in a direction away from the conductive block 60. In this embodiment, the first projecting portion 42*b* is a first bent portion which projects toward the conductive block 60, and the second projecting portion 42*c* is a second bent portion which projects in a direction away from the conductive block 60. Each outer contact 42 is in a form of leaf spring which can elastically deform. The first projecting portion 42*b* and the second projecting portion 42*c* are also configured to be able to elastically deform. The first projecting portion 42*b* and the second projecting portion 42*c* are electrically connected to each other. In FIG. 35, each outer contact 42 has two projecting portions 42*b*, 42*c*, while the number of projecting portions is not limited to this embodiment. For example, the outer contact 42 may have a plurality of first projecting portions 42*b* and/or a plurality of second projecting portions 42*c*.

As shown in FIG. 35, the conductive block 60 is pressed against the first projecting portions 42*b* by the spring 63, thereby causing elastic deformation of all of the outer contacts 42. As a result, the conductive block 60 is in contact with all of the first projecting portions 42*b* (i.e., all of the outer contacts 42), whereby the outer contacts 42 are electrically connected to each other through the conductive block 60.

Figure 36:
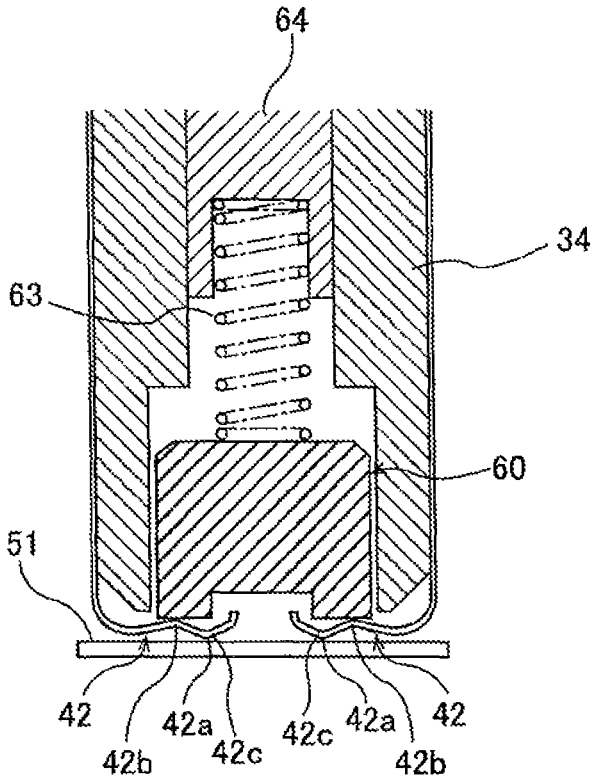
FIG. 36 is a cross-sectional view showing a part of the substrate holder when the outer contacts are pressed against the feeding terminal.

The conductive block 60 is pressed against the first projecting portions 42*b*, while the second projecting portions 42*c* are located away from the conductive block 60. Lower surfaces of the second projecting portions 42*c* provide contact surfaces 42*a* which are to be brought into contact with the feeding terminal 51. When the holder hanger 34 is supported by the holder support member 50 (see FIG. 26), as shown in FIG. 36, the contact surfaces 42*a* of the second projecting portions 42*c* are pressed against the feeding terminal 51 by the own weight of the substrate holder 8, whereby the outer contacts 42 are electrically connected to the feeding terminal 51.

Figure 37:
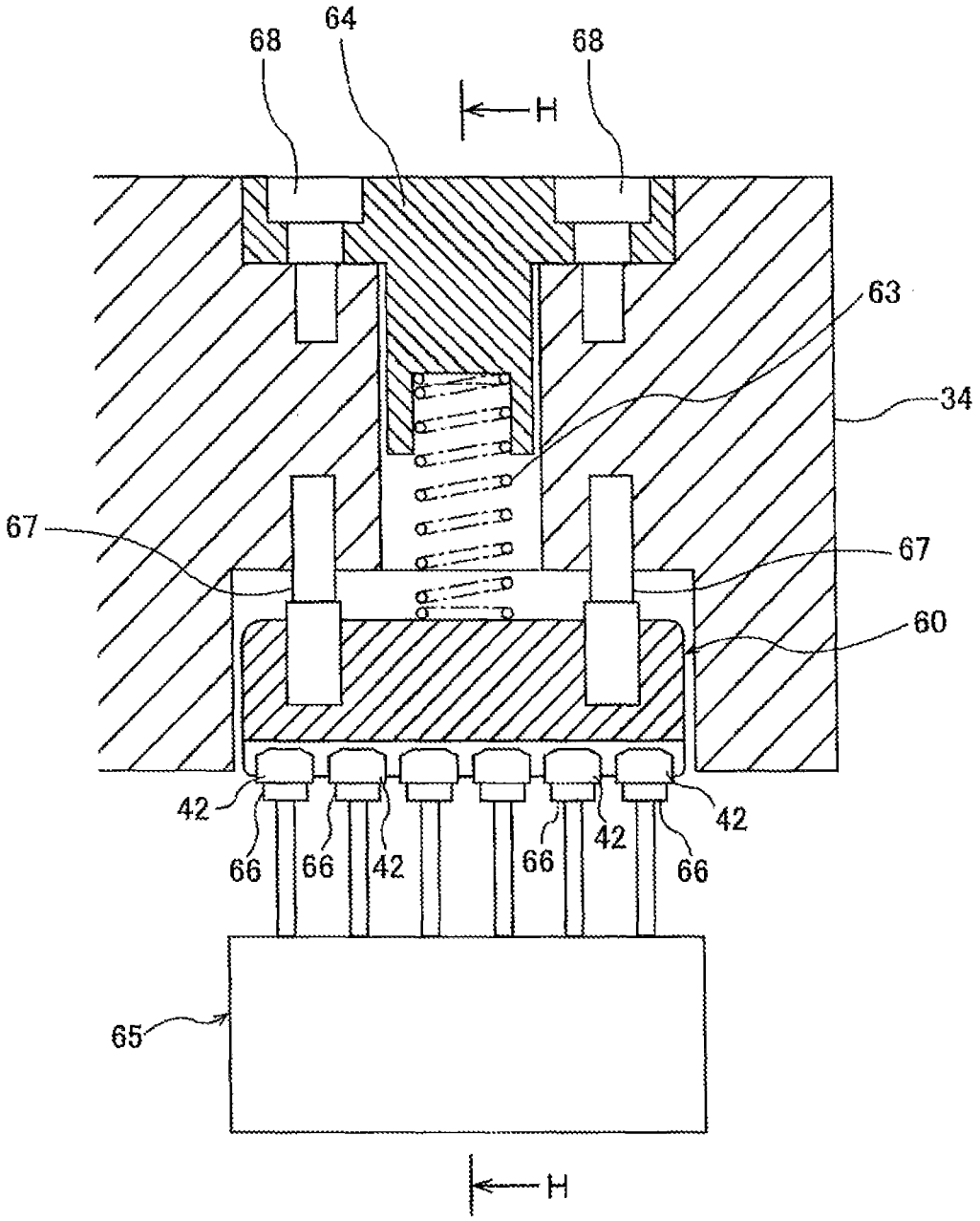
FIG. 37 is a view showing the resistance-measuring device which is brought into contact with contact surfaces of the outer contacts.
Figure 38:
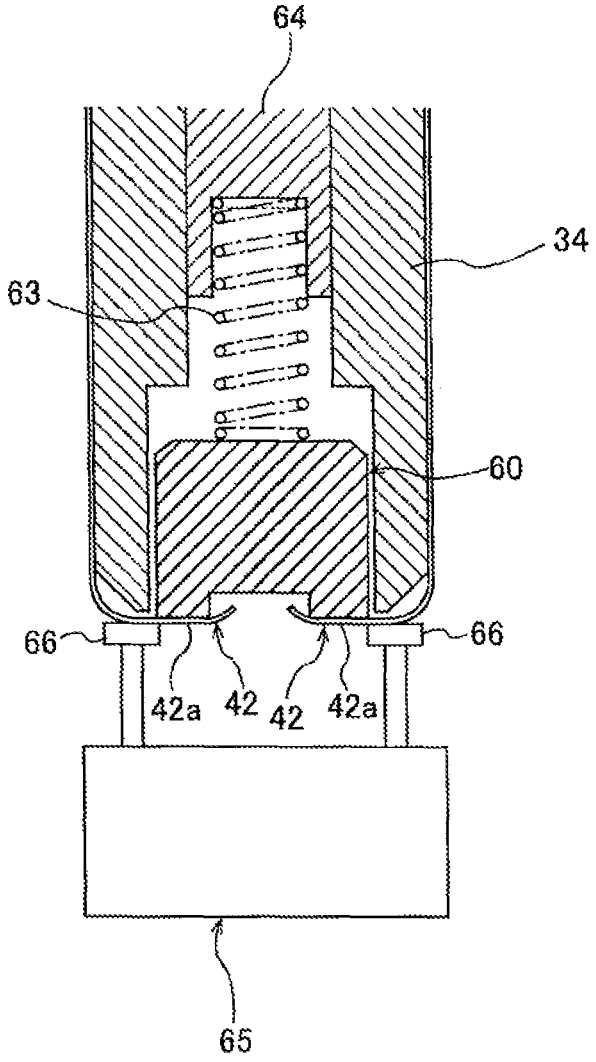
FIG. 38 is a cross-sectional view taken along line H-H of FIG. 37.

As described above, the variation in the electrical resistance of the inner contacts 45 and/or the conductive film of the substrate W has the adverse influence on plating of a substrate W. Thus, it is desirable to measure the electrical resistance between the outer contacts 42 before the plating of the substrate W is started. FIG. 37 is a view showing resistance-measuring device 65 which is brought into contact with the contact surfaces 42*a* of the outer contacts 42. FIG. 38 is a cross-sectional view taken along line H-H of FIG. 37. As shown in FIG. 37 and FIG. 38, the resistance-measuring device 65 has as many probes 66 as the outer contacts 42 (twelve probes 66 in this embodiment).

Two types of measuring of the electrical resistance between the outer contacts 42 are performed. A first measuring is performed without holding the substrate W with the substrate holder 8. FIG. 37 and FIG. 38 show the resistance-measuring device 65 and a part of the substrate holder 8 when the first measuring is being performed. When the conductive block 60 is in contact with the outer contacts 42, the probes 66 of the resistance-measuring device 65 are brought into contact with the contact surfaces 42*a*, and the electrical resistance between the outer contacts 42 is then measured.

If a foreign matter exists between the outer contact 42 and the conductive block 60, the electrical resistance may change. The above-described first measuring is performed in order to check the connection between the outer contacts 42 and the conductive block 60. That is, as described above, the electrical resistance is measured when the substrate holder 8 is not holding the substrate and the conductive block 60 is in contact with the outer contacts 42. From results of this first measuring, it is possible to check whether or not the outer contacts 42 and the conductive block 60 are properly connected.

Figure 39:
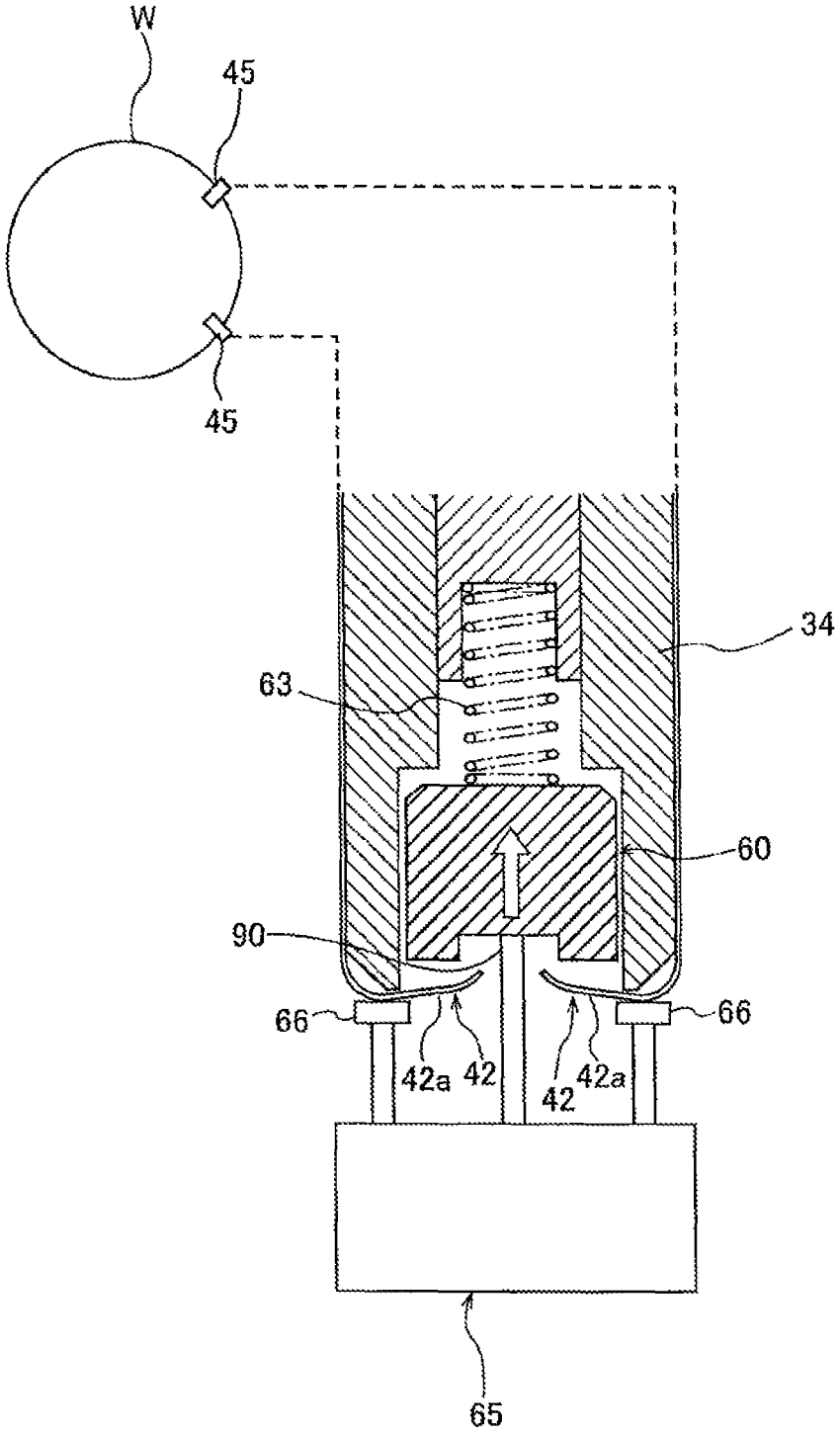
FIG. 39 is a view showing a manner of measuring of the electrical resistance while the conductive block is pushed up.

A second measuring is performed when the substrate W is held by the substrate holder 8 and when the conductive block 60 is located away from the outer contacts 42. FIG. 39 is a view showing the resistance-measuring device 65 and a part of the substrate holder 8 when the second measuring is being performed. The resistance-measuring device 65 includes a protrusion 90 configured to push up the conductive block 60. The protrusion 90 pushes up the conductive block 60 until the conductive block 60 is separated from the outer contacts 42. In this state, the resistance-measuring device 65 measures the electrical resistance between the outer contacts 42. As described above, since the second measuring is performed while the substrate W is held by the substrate holder 8, it is possible to detect whether or not there is a defect in the inner contacts 45 and/or the conductive film of the substrate W.

While the two types of measuring of the electrical resistance between the outer contacts 42 are performed in this embodiment, only the second measuring may be performed without performing the first measuring.

Measuring of the electrical resistance between the outer contacts 42 by the resistance-measuring device 65 is automatically performed at the substrate loader (not shown) for loading the substrate W into the substrate holder 8.

Figure 40:
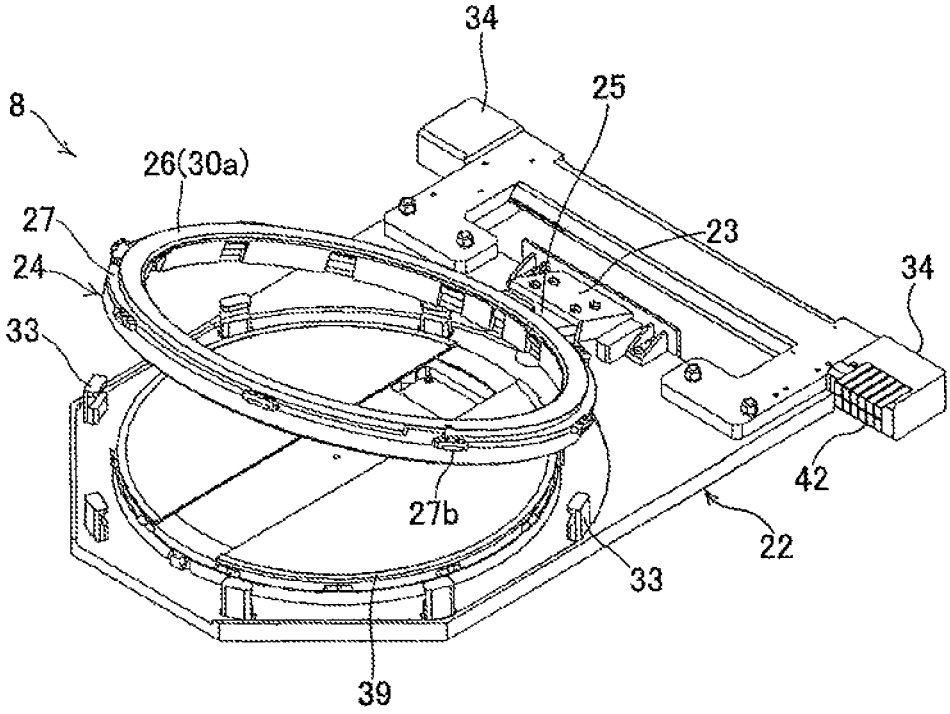
FIG. 40 is a perspective view showing another embodiment of the substrate holder.
Figure 42:
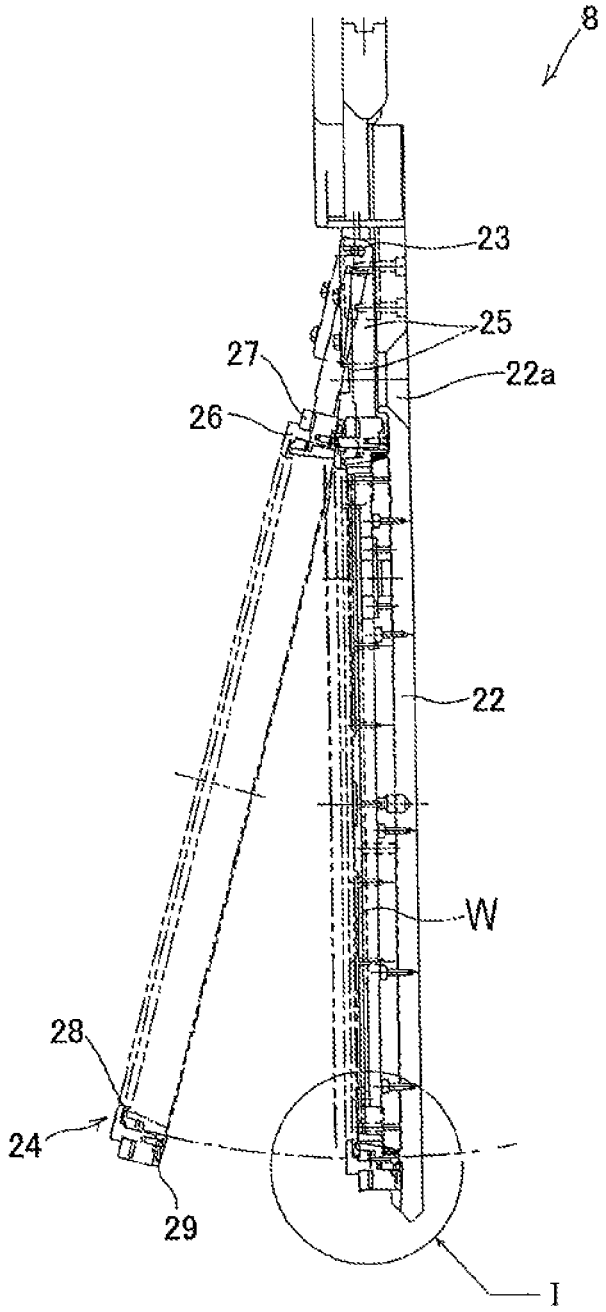
FIG. 42 is a right-side view of the substrate holder shown in FIG. 40.
Figure 43:
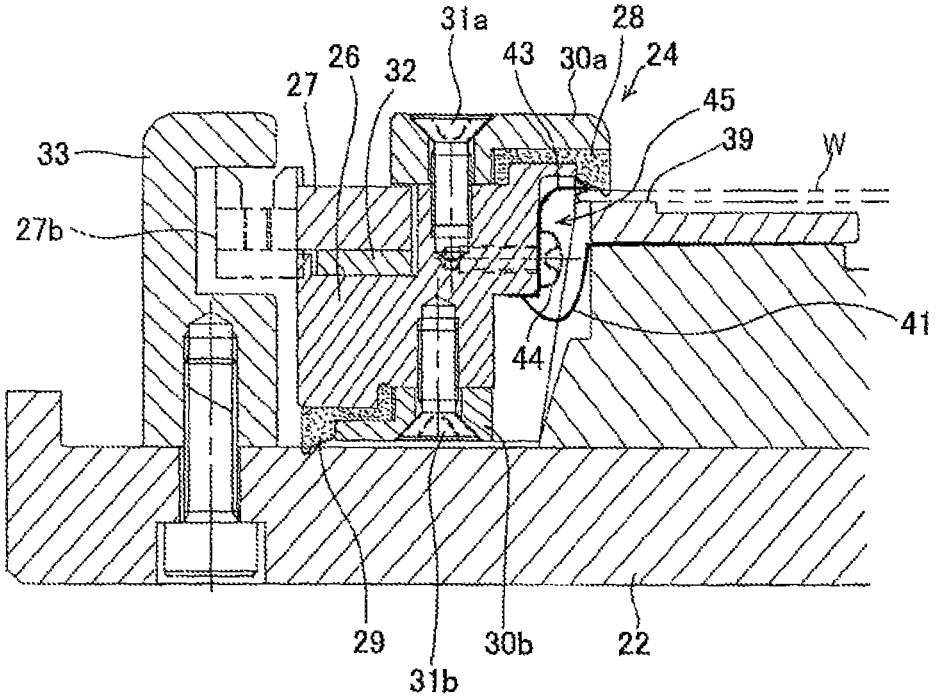
FIG. 43 is an enlarged view showing an encircled area indicated by symbol I shown in FIG. 42.

Next, another embodiment will be described with reference to FIG. 40 through FIG. 54. Structures and operations of this embodiment, which will not be described particularly, are the same as those of the embodiment that has been described with reference to FIG. 1 through FIG. 6, and their repetitive descriptions are omitted. FIG. 40 is a perspective view showing another embodiment of the substrate holder 8, FIG. 41 is a plan view of the substrate holder 8 shown in FIG. 40, FIG. 42 is a right-side view of the substrate holder 8 shown in FIG. 40, and FIG. 43 is an enlarged view showing an encircled area indicated by symbol I shown in FIG. 42.

Figure 41:
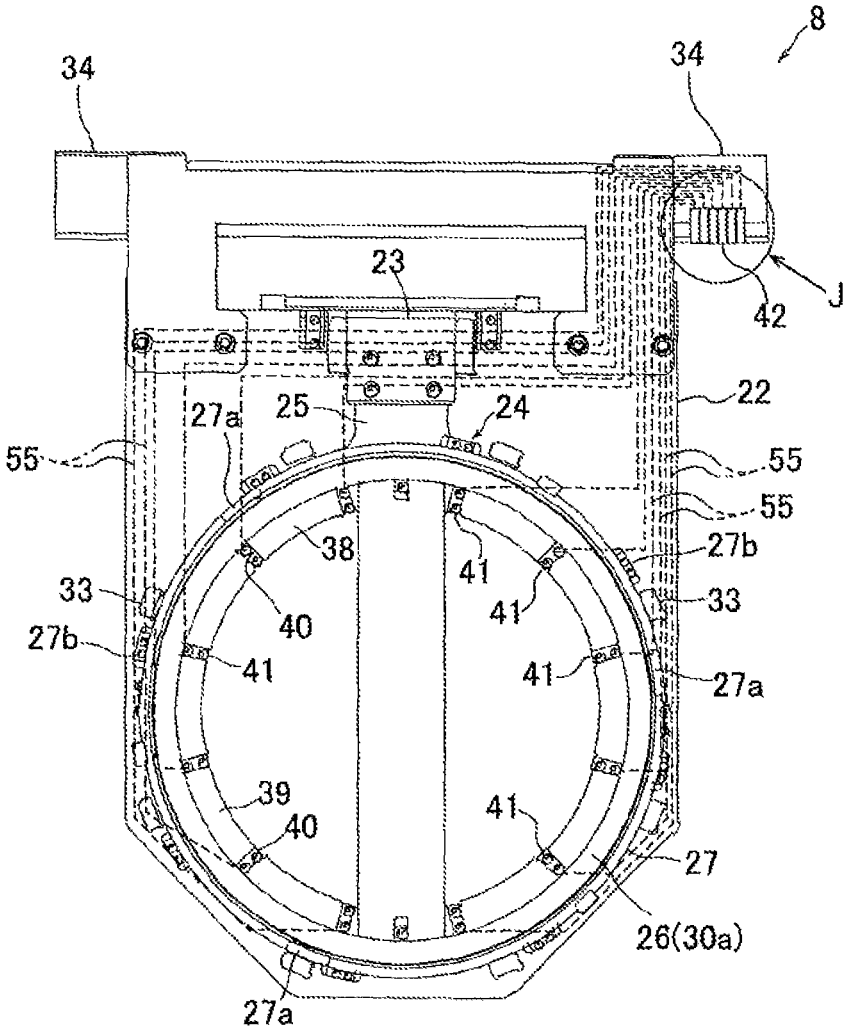
FIG. 41 is a plan view of the substrate holder shown in FIG. 40.

As shown in FIG. 40 and FIG. 41, outer contacts 42 are attached to the holder hanger 34. While six outer contacts 42 are shown in FIG. 41, other six outer contacts 42 are disposed behind the outer contacts 42 shown in FIG. 41, as can be seen from FIG. 40. Therefore, a total of twelve outer contacts 42 are provided. The twelve outer contacts 42 are coupled to twelve conductive members 41 through twelve wires 55, respectively. These twelve wires 55 have the same length as each other.

Figure 44:
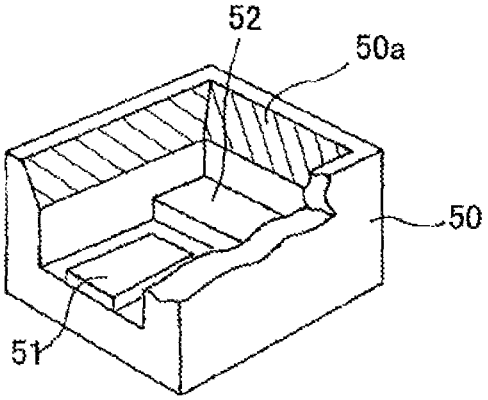
FIG. 44 is a view showing a holder support member which holds the substrate holder.

The substrate holder 8 is suspended from the surrounding wall of the plating tank 1 (see FIG. 1) through the holder hanger 34. FIG. 44 is a view showing holder support member 50 secured to the surrounding wall of the plating tank 1. The holder support member 50 for supporting the holder hanger 34, provided with the outer contacts 42, is secured to the surrounding wall of the plating tank 1. As shown in FIG. 44, the holder support member 50 has an opening portion 50*a* formed in an upper surface of the holder support member 50. The outer contacts 42 are set in the holder support member 50 through the opening portion 50*a*. Feeding terminal 51, which is coupled to the power source 18 (see FIG. 1), is provided in the holder support member 50. The outer contacts 42 are brought into contact with the feeding terminal 51.

Figure 45:
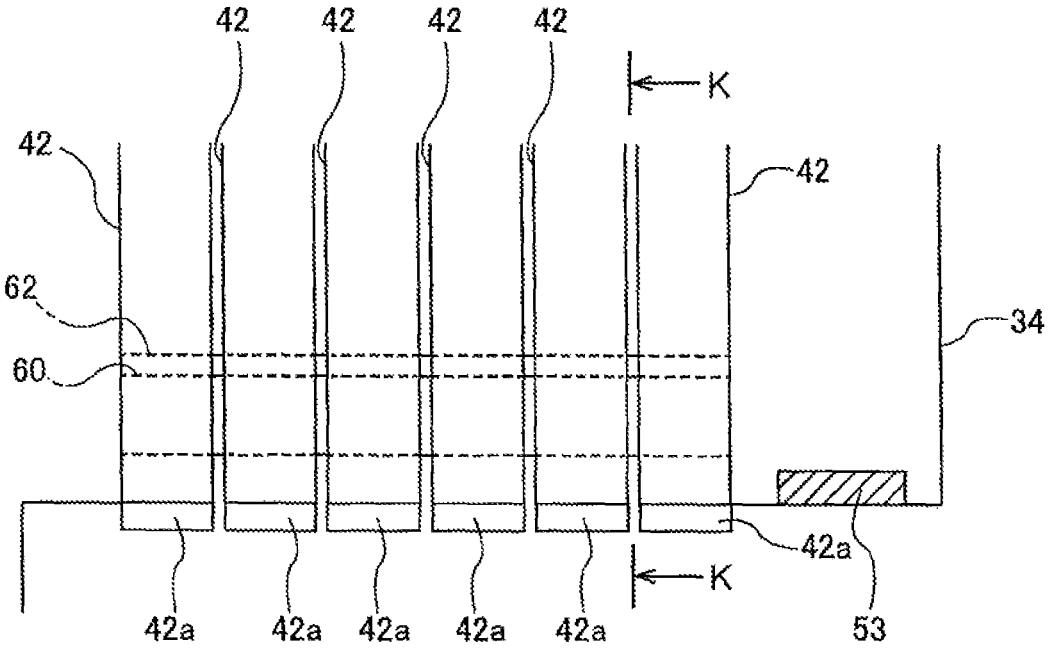
FIG. 45 is an enlarged view showing an encircled area indicated by symbol J shown in FIG. 41.
Figure 46:
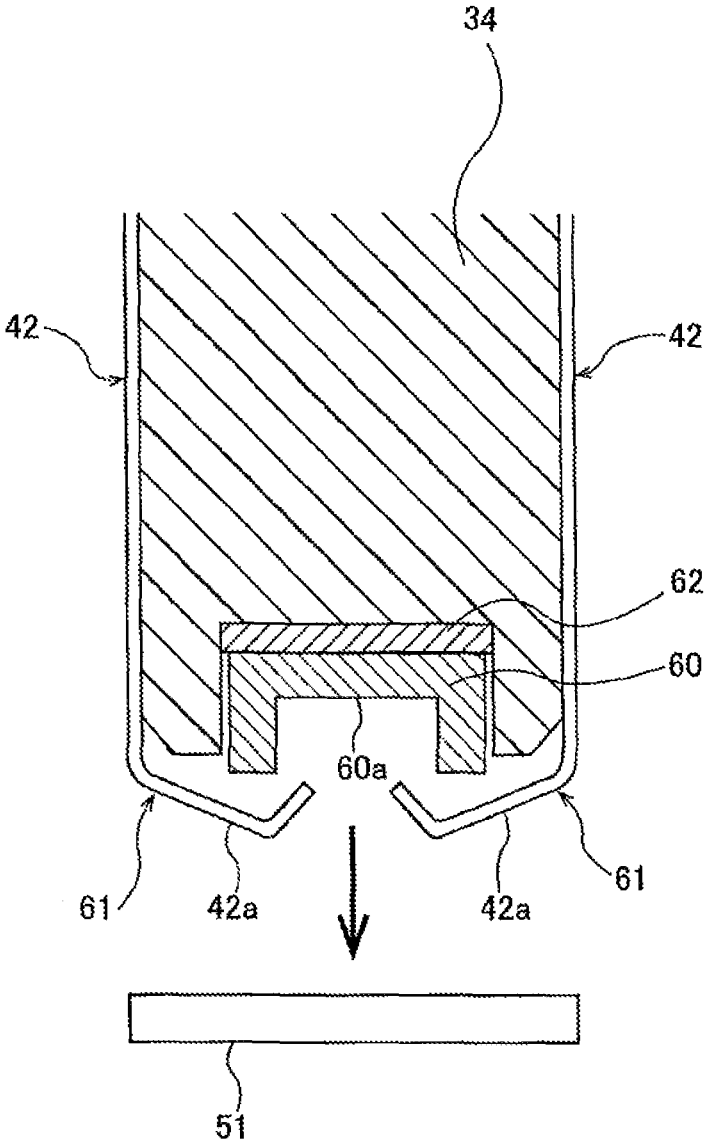
FIG. 46 is a cross-sectional view taken along line K-K of FIG. 45.

FIG. 45 is an enlarged view showing an encircled area indicated by symbol 3 shown in FIG. 41. FIG. 46 is a cross-sectional view taken along line K-K of FIG. 45. The outer contacts 42 have contact surfaces 42*a*, respectively, which are to be brought into contact with the feeding terminal 51. The outer contacts 42 are electrically connected to the inner contacts 45 through the wires 55 (see FIG. 41), respectively. Specifically, the twelve outer contacts 42 are coupled to the twelve inner contacts 45, respectively.

When the substrate holder 8 is suspended from the surrounding wall of the plating tank 1, the contact surfaces 42*a* of the outer contacts 42 are pressed against the feeding terminal 51 by the own weight of the substrate holder 8, whereby the outer contacts 42 are electrically connected to the feeding terminal 51. The electric current is passed through the outer contacts 42 and the inner contacts 45 to the periphery of the substrate W, so that the surface of the substrate W is plated.

During plating of the substrate W, if the substrate holder 8 swings due to the motion of the paddle 16, the outer contacts 42 may be intermittently connected to the feeding terminal 51. Thus, in order to prevent such intermittent connection, as shown in FIG. 44 and FIG. 45, the holder support member 50 has a magnet 52, and the substrate holder 8 has a magnet 53. The substrate holder 8 is firmly held on the plating tank 1 by a magnetic force acting between these magnets 52, 53, which can ensure the contact between the outer contacts 42 and the feeding terminal 51.

As shown in FIG. 46, the substrate holder 8 includes a conductive block 60 arranged above the outer contacts 42. This conductive block 60 is located in back of the contact surface 42*a*, and is located away from the outer contacts 42. The conductive block 60 is made of conductive material. For example, the conductive block 60 may be made of copper plated with gold. A groove 60*a*, which extends along an arrangement direction of the outer contacts 42, is formed in a lower surface of the conductive block 60. As shown in FIG. 45, the conductive block 60 extends along the arrangement direction of the outer contacts 42, and is arranged so as to face back-side surfaces of all of the outer contacts 42 which are opposite sides from the contact surfaces 42*a*. The conductive block 60 is located near the outer contacts 42. When the outer contacts 42 are moved in a direction indicated by arrow shown in FIG. 46, the contact surfaces 42*a* are pressed against the feeding terminal 51.

Figure 47:
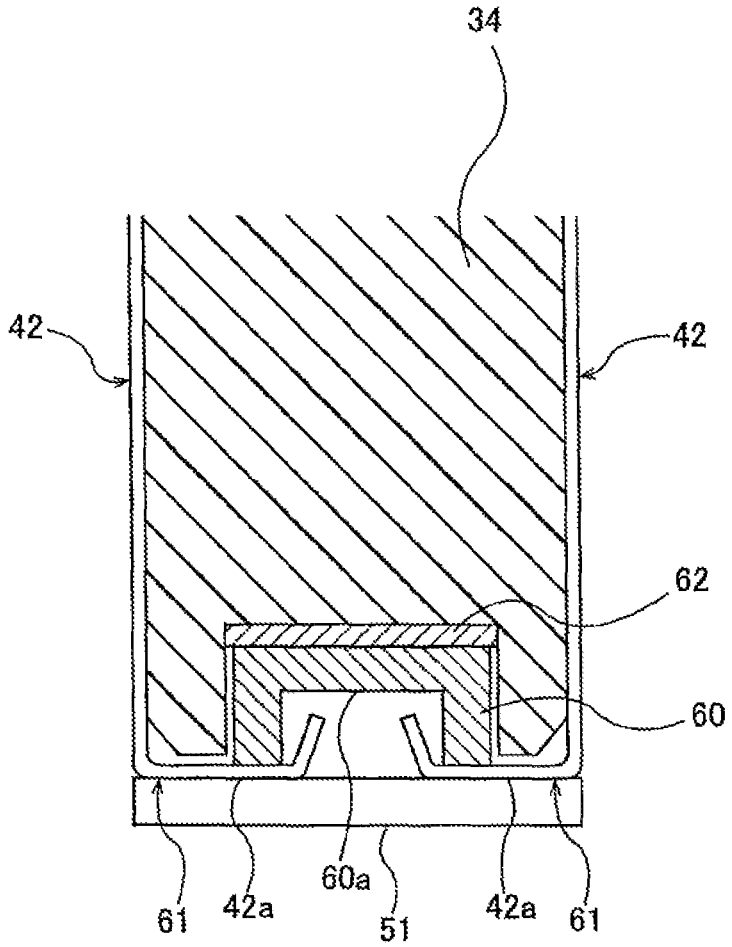
FIG. 47 is a view showing the outer contacts and the conductive block when the contact surfaces are pressed against the feeding terminal.

The outer contacts 42 have elasticity. More specifically, the outer contacts 42 include leaf springs 61, respectively, which are elastic members which can deform until the outer contacts 42 are brought into contact with the conductive block 60 when the contact surfaces 42*a* are pressed against the feeding terminal 51. Each leaf spring 61 constitutes a lower end portion of each outer contact 42, and a lower surface of the leaf spring 61 constitutes the contact surface 42*a*. FIG. 47 is a view showing the outer contacts 42 and the conductive block 60 when the contact surfaces 42*a* are pressed against the feeding terminal 51. As shown in FIG. 47, when the contact surfaces 42*a* are pressed against the feeding terminal 51, the back-side surfaces of all of the outer contacts 42, located across from the contact surfaces 42*a*, are brought into contact with the conductive block 60. Therefore, all of the outer contacts 42 are electrically connected to each other through the conductive block 60.

If a surface of the feeding terminal 51 is deteriorated, or a foreign matter is attached to the surface of the feeding terminal 51, the electrical resistance between the feeding terminal 51 and the outer contact 42 may change. As a result, non-uniform electric current may flow through the outer contacts 42 to the inner contacts 45. Even in such a case, the conductive block 60 can eliminate a variation in the electrical resistance between the outer contacts 42 by electrically connecting all of the outer contacts 42. Therefore, uniform electric current is passed through the outer contacts 42 to the inner contacts 45. As a result, a metal film with a uniform thickness can be formed on the surface of the substrate W.

As shown in FIG. 46 and FIG. 47, the conductive block 60 is held by an elastic holding member 62. This elastic holding member 62 is attached to the holder hanger 34. The elastic holding member 62 may be a rubber, a sponge, a spring, or the like. If the elastic holding member 62 is not provided, the leaf springs 61 may not deform sufficiently when the contact surfaces 42*a* are pressed against the feeding terminal 51. In an extreme case, gaps may be created between the leaf springs 61 and the conductive block 60. In particular, when the substrate holder 8 is forced to slightly swing due to the motion of the paddle 16 agitating the plating solution, the outer contacts 42 may be intermittently connected to the feeding terminal 51. The elastic holding member 62 allows the leaf springs 61 to deform sufficiently so that the leaf springs 61 can be in tight contact with the conductive block 60 at sufficient contact pressure. In a case where a small electric current is passed to the substrate W, the conductive block 60 itself may be constituted by an elastic member (e.g., leaf spring).

As shown in FIG. 46 and FIG. 47, a small gap is formed between a side surface of the conductive block 60 and the holder hanger 34. Thus, even if the substrate holder 8, with its attitude inclined slightly, is set onto the holder support member 50, the elastic holding member 62 is allowed to deform, thereby reducing an inclination of the conductive block 60. As a result, the leaf springs 61 can sufficiently be in contact with the conductive block 60, thus stably keeping the contact pressure between the leaf springs 61 and the conductive block 60.

Figure 48:
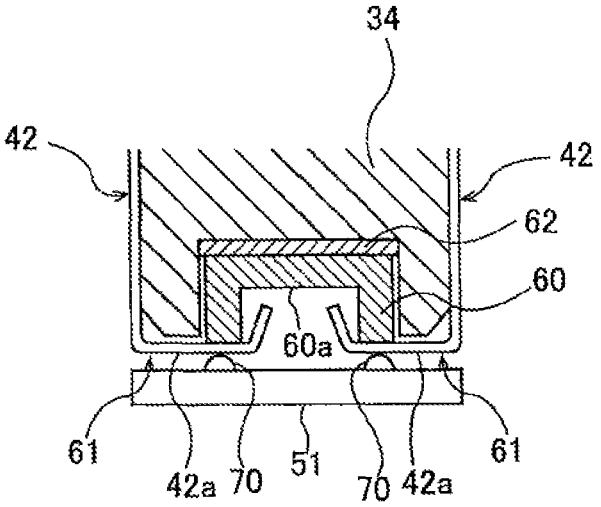
FIG. 48 is a view showing another example of the feeding terminal.
Figure 49:
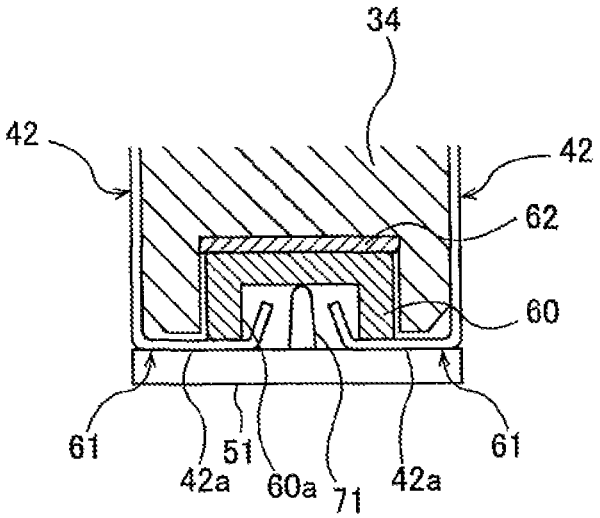
FIG. 49 is a view showing still another example of the feeding terminal.

FIG. 48 is a view showing another example of the feeding terminal 51. FIG. 49 is a view showing still another example of the feeding terminal 51. As shown in FIG. 48, the feeding terminal 51 may have, on its upper surface, projecting portions 70 which are made of conductive material. The projecting portions 70 are provided as many as the outer contacts 42 so that these projecting portions 70 are brought into contact with the contact surfaces 42*a* of the outer contacts 42, respectively. Although not shown in the drawings, twelve projecting portions 70 are provided in this embodiment, because twelve outer contacts 42 are provided. The contact surfaces 42*a* are pressed against the projecting portions 70 of the feeding terminal 51 at high pressure, thus ensuring the contact between the outer contacts 42 and the conductive block 60. These projecting portions 70 may be formed from elastically deformable members.

As shown in FIG. 49, an auxiliary terminal 71, which is projecting toward the conductive block 60, may be provided on the feeding terminal 51. This auxiliary terminal 71 is made of conductive material. When the contact surfaces 42*a* are pressed against the feeding terminal 51 until the outer contacts 42 are brought into contact with the conductive block 60, the auxiliary terminal 71 is brought into contact with the conductive block 60. The electric current flows to the outer contacts 42 through the contact between the contact surfaces 42*a* and the feeding terminal 51, while the electric current flows through the auxiliary terminal 71 and the conductive block 60 to the outer contacts 42. Therefore, the auxiliary terminal 71 can ensure the supply of the electric current from the feeding terminal 51 to the conductive block 60. The projecting portions 70 shown in FIG. 48 and the auxiliary terminal 71 shown in FIG. 49 may be combined.

Figure 50:
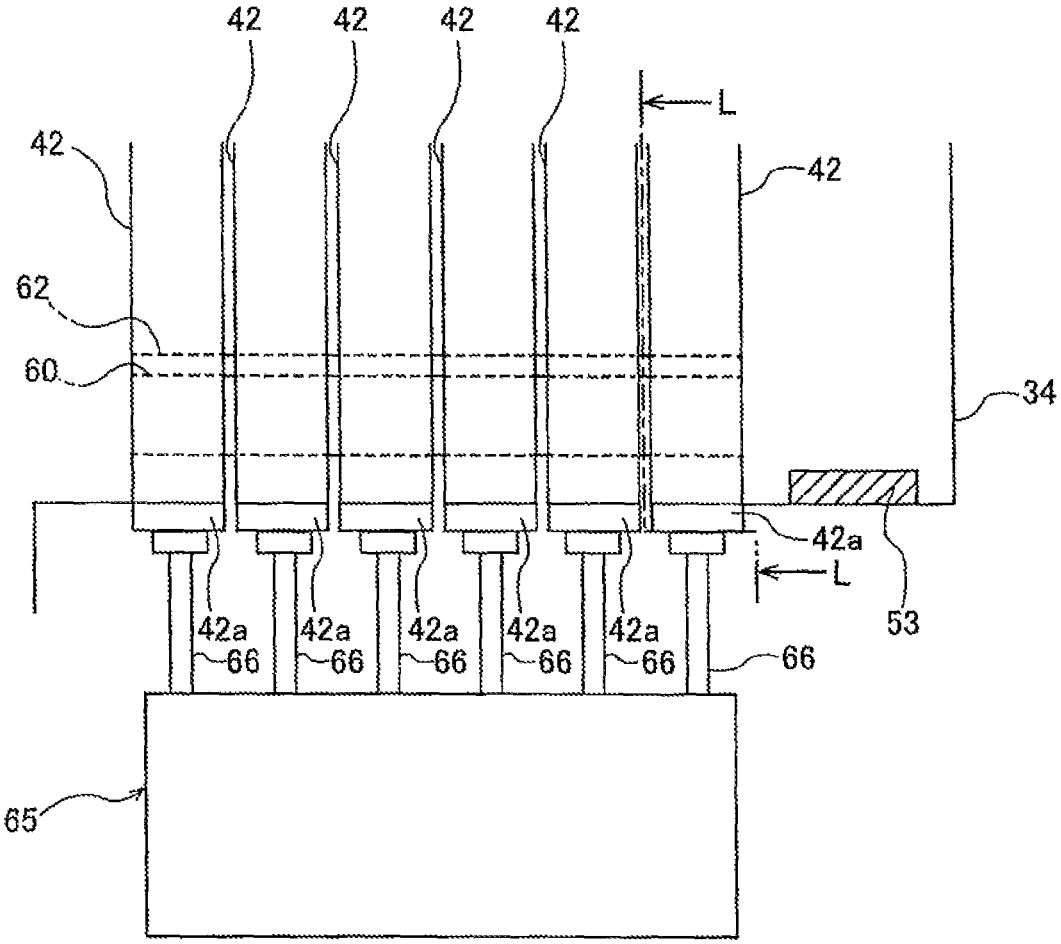
FIG. 50 is a view showing the resistance-measuring device which is brought into contact with the contact surfaces of the outer contacts.
Figure 51:
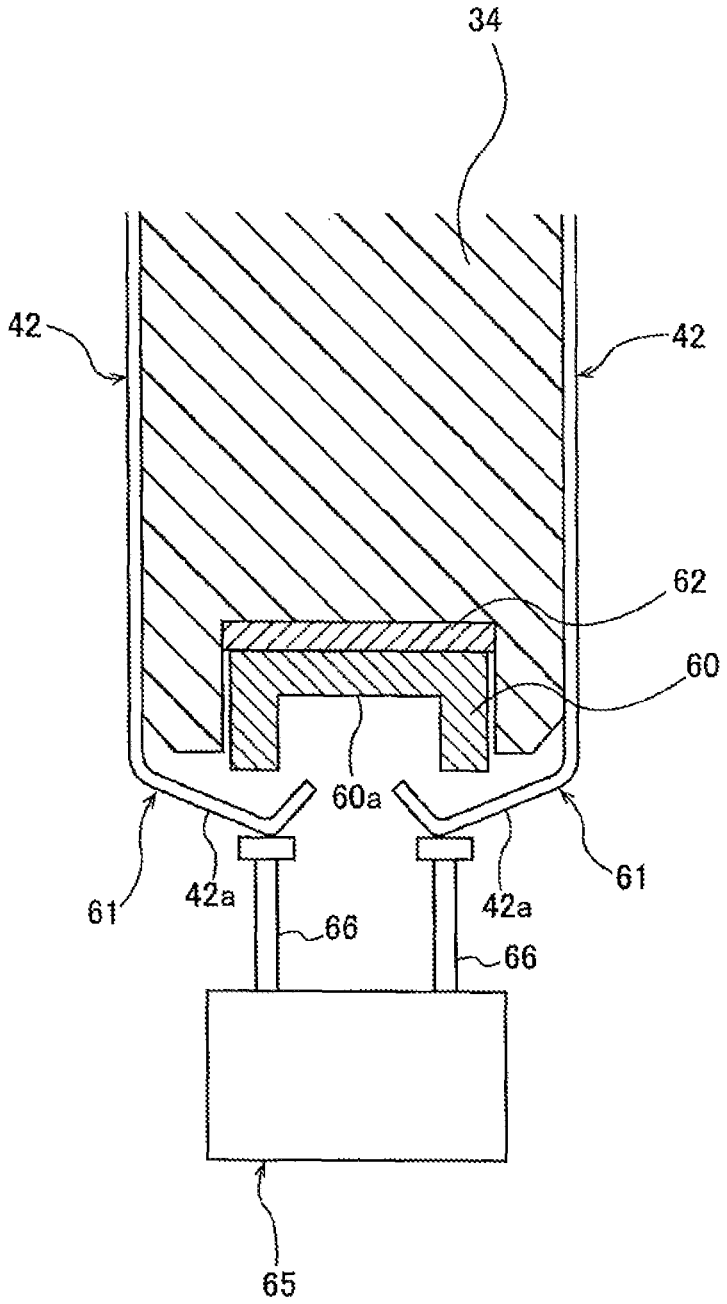
FIG. 51 is a cross-sectional view taken along line L-L of FIG. 50.

As described above, the variation in the electrical resistance of the inner contacts 45 and/or the conductive film of the substrate W has an adverse influence on the plating of the substrate W. Thus, it is desirable to measure the electrical resistance between the outer contacts 42 when the substrate holder 8 is holding the substrate W before plating of the substrate W is started. FIG. 50 is a view showing resistance-measuring device 65 which is brought into contact with the contact surfaces 42*a* of the outer contacts 42. FIG. 51 is a cross-sectional view taken along line L-L of FIG. 50. As shown in FIG. 50 and FIG. 51, the resistance-measuring device 65 has as many spring probes 66 as the outer contacts 42 (twelve spring probes 66 in this embodiment).

These spring probes 66 are configured to be able to expand and contract. The spring probes 66 contract when the spring probes 66 are brought into contact with the contact surfaces 42*a* of the outer contacts 42. Therefore, the leaf springs 61 hardly deform, and the outer contacts 42 are not brought into contact with the conductive block 60. The resistance-measuring device 65 can measure the electrical resistance between the outer contacts 42. The resistance-measuring device 65 may include rigid terminals as resistance-measuring terminals, instead of the spring probes 66. In this case, a stroke distance for pressing the rigid terminals against the outer contacts 42 are adjusted such that the outer contacts 42 are not brought into contact with the conductive block 60.

Measuring of the electrical resistance between the outer contacts 42 by the resistance-measuring device 65 is performed in the substrate loader (not shown) for loading the substrate W into the substrate holder 8. First, the substrate holder 8 is transported to the substrate loader by a substrate transport mechanism (not shown). The substrate holder 8 is opened, and the substrate W is inserted into the substrate holder 8. The substrate holder 8 is then closed, and the substrate holder 8 is locked. Thereafter, the electrical resistance between each pair of the outer contacts 42 is measured by the resistance-measuring device 65. If an abnormal value of the electrical resistance is detected in this measurement, it is judged that a defect exists in the conductive layer and/or the inner contacts 45. Therefore, the substrate W and/or the substrate holder 8 is replaced.

Figure 52:
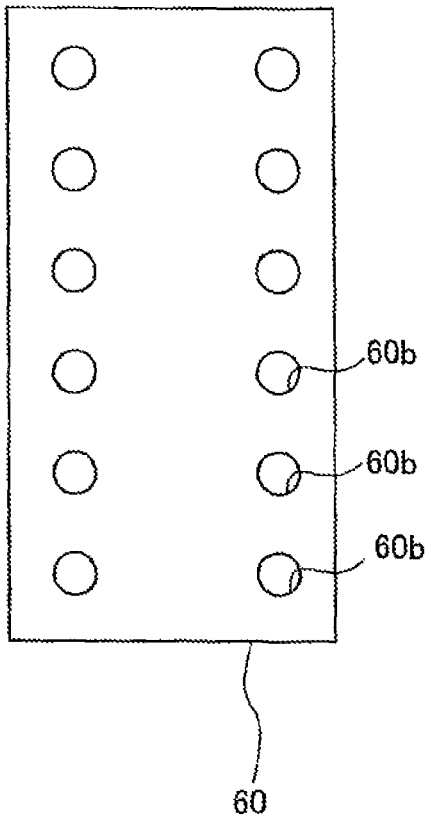
FIG. 52 is a plan view of the conductive block according to another embodiment.
Figure 53A:
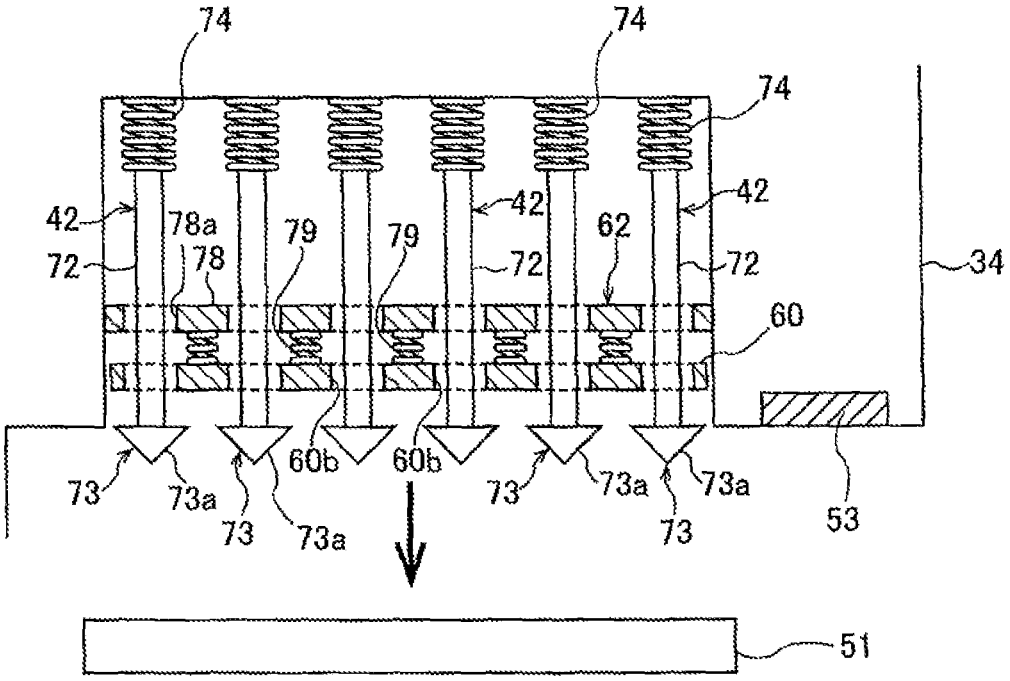
FIG. 53A is a view showing the conductive block shown in FIG. 52 and the outer contacts.
Figure 53B:
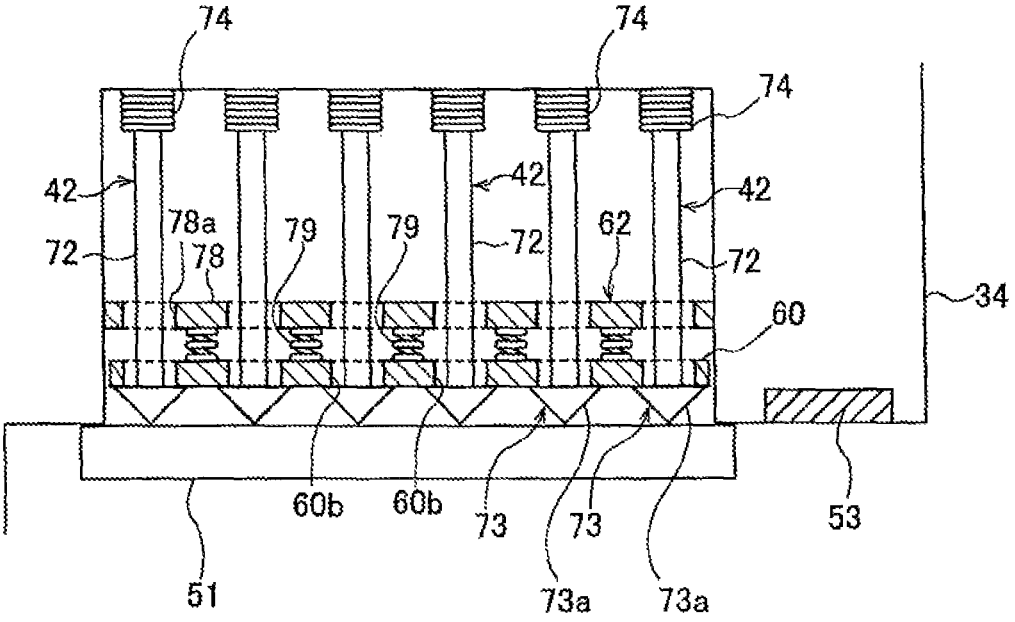
FIG. 53B is a view showing the conductive block shown in FIG. 52 and the outer contacts.

FIG. 52 is a plan view of the conductive block 60 according to another embodiment. FIG. 53A and FIG. 53B are views showing the conductive block 60 shown in FIG. 52 and the outer contacts 42. As shown in FIG. 52, the conductive block 60 has a plurality of (twelve) through-holes 60*b*. As shown in FIG. 53A and FIG. 53B, the outer contacts 42 include a plurality of conductive rods 72 extending downwardly through the through-holes 60*b*, a plurality of conductive flanges 73 secured to end portions of the conductive rods 72, respectively, and a plurality of springs 74 for biasing the conductive rods 72 in a direction such that the conductive flanges 73 are separated from the conductive block 60. In this embodiment, each spring 74 constitutes the above-described elastic body, and contact surfaces 73*a* of the conductive flanges 73 constitute the above-described contact surfaces. Since the outer contacts 42 shown in FIG. 53A and FIG. 53B have the springs 74, respectively, each of the outer contacts 42 has the elasticity as a whole.

The conductive block 60 is held by an elastic holding member 62. This elastic holding member 62 includes a base 78 arranged above the conductive block 60, and a plurality of spring spacers 79 arranged between the base 78 and the conductive block 60. The spring spacers 79 couple the base 78 and the conductive block 60 to each other. The base 78 is secured to the holder hanger 34. The base 78 has a plurality of through-holes 78*a*, as with the conductive block 60 shown in FIG. 52. The conductive rods 72 extend downwardly through these through-holes 60*b*, 78*a*. The conductive rods 72 are kept out of contact with the conductive block 60 and the base 78.

The conductive rods 72 and the conductive flanges 73 are made of conductive material. The conductive rods 72 are coupled to the inner contacts 45 (see FIG. 43) through the wires 55 (see FIG. 41), respectively. As shown in FIG. 53B, when the contact surfaces 73*a* of the conductive flanges 73 are pressed against the feeding terminal 51, the springs 74 contract until the conductive flanges 73 are brought into contact with the conductive block 60. The conductive flanges 73 and the conductive rods 72 are electrically connected to each other through the conductive block 60. Therefore, uniform electric current is passed through the conductive block 60 to the outer contacts 42. Although not shown in the drawings, the elastic holding member 62 may be a rubber, a sponge, or the like.

FIG. 54 is a view showing the resistance-measuring device 65 which is brought into contact with the contact surfaces 73*a* of the conductive flanges 73. As shown in FIG. 54, when the spring probes 66 are brought into contact with the contact surfaces 73*a* of the conductive flanges 73, the spring probes 66 contract. Therefore, the conductive flanges 73 are not brought into contact with the conductive block 60. Hence, the resistance-measuring device 65 can measure the electrical resistance between the outer contacts 42.

While the embodiments of the present invention have been described above, the present invention is not limited to the above embodiments, and may be reduced to practice in various different forms within the scope of the technical concept of the present invention.

INDUSTRIAL APPLICABILITY

The present invention is applicable to a plating method, a plating apparatus, and a substrate holder for holding a substrate, such as a wafer, for use in the plating apparatus.

The invention claimed is:

1. A substrate holder comprising:

inner contacts to be brought into contact with a periphery of a substrate for passing an electric current to the substrate;

outer contacts each having elasticity, the outer contacts having contact surfaces, respectively, to be brought into contact with a feeding terminal coupled to a power source, the outer contacts being coupled to the inner contacts, respectively; and a conductive block arranged in back of the contact surfaces having a first position not in contact with the outer contacts, wherein the outer contacts are deformable until the outer contacts are brought into contact with the conductive block in a second position when the contact surfaces are pressed against the feeding terminal.

2. The substrate holder according to claim 1, wherein the conductive block is held by an elastic holding member.

3. The substrate holder according to claim 1, wherein the outer contacts have leaf springs, respectively.

4. The substrate holder according to claim 1, wherein the conductive block has through-holes, the outer contacts including:

conductive rods extending through the through-holes;

conductive flanges secured to end portions of the conductive rods, respectively, the conductive flanges having lower surfaces constituting the contact surfaces; and springs biasing the conductive rods in a direction such that the conductive flanges are biased toward a non-contact position with the conductive block.

5. An apparatus for plating a substrate, comprising:

a plating tank for holding a plating solution therein;

a substrate holder configured to hold a substrate and place the substrate in the plating tank;

an anode disposed in the plating tank so as to face the substrate held by the substrate holder; and a power source configured to apply a voltage between the substrate and the anode, wherein the substrate holder includes:

inner contacts to be brought into contact with a periphery of the substrate for passing an electric current to the substrate;

outer contacts each having elasticity, the outer contacts having contact surfaces, respectively, to be brought into contact with a feeding terminal coupled to the power source, the outer contacts being coupled to the inner contacts, respectively; and a conductive block arranged in back of the contact surfaces having a first position not in contact with the outer contacts, wherein the outer contacts are deformable until the outer contacts are brought into contact with the conductive block in a second position when the contact surfaces are pressed against the feeding terminal.

6. The apparatus according to claim 5, wherein the conductive block is held by an elastic holding member.

7. The apparatus according to claim 5, wherein the outer contacts have leaf springs, respectively.

8. The apparatus according to claim 5, further comprising an auxiliary terminal projecting toward the conductive block, the auxiliary terminal being provided on the feeding terminal, and the auxiliary terminal being brought into contact with the conductive block when the outer contacts are brought into contact with the conductive block.

9. The apparatus according to claim 5, wherein the conductive block has through-holes, the outer contacts including:

conductive rods extending through the through-holes;

conductive flanges secured to end portions of the conductive rods, respectively, the conductive flanges having lower surfaces constituting the contact surfaces; and springs biasing the conductive rods in a direction such that the conductive flanges are biased toward a non-contact position with the conductive block.

10. A method of plating a substrate using a substrate holder having inner contacts for passing an electric current to the substrate, and outer contacts to be brought into contact with a feeding terminal coupled to a power source, the method comprising:

bringing the inner contacts into contact with a periphery of the substrate;

measuring an electrical resistance between the outer contacts by a resistance-measuring device which is brought into contact with the outer contacts, while establishing a contact between first intermediate contacts and second intermediate contacts, the first intermediate contacts being electrically connected to the inner contacts, respectively, and the second intermediate contacts being electrically connected to the outer contacts, respectively;

inserting a conductive block between the first intermediate contacts and the second intermediate contacts until the conductive block is in contact with the first intermediate contacts and the second intermediate contacts, thereby electrically connecting the first intermediate contacts and the second intermediate contacts to each other through the conductive block;

bringing the outer contacts into contact with the feeding terminal while immersing the substrate in a plating solution; and plating the substrate by applying a voltage between an anode disposed in the plating solution and the substrate.

11. The method according to claim 10, further comprising:

before bringing the inner contacts into contact with the periphery of the substrate, inserting the conductive block between the first intermediate contacts and the second intermediate contacts and measuring an electrical resistance between the outer contacts by the resistance-measuring device which is brought into contact with the outer contacts.

12. An apparatus for plating a substrate, comprising:

a plating tank for holding a plating solution therein;

an anode disposed in the plating tank;

a substrate holder for holding a substrate;

a power source configured to apply a voltage between the anode and the substrate; and a resistance-measuring device configured to measure an electrical resistance between outer contacts of the substrate holder, wherein the substrate holder includes:

inner contacts to be brought into contact with a periphery of the substrate;

first intermediate contacts electrically connected to the inner contacts, respectively;

the outer contacts to be brought into contact with a feeding terminal coupled to the power source;

second intermediate contacts electrically connected to the outer contacts, respectively; and a conductive block being movable between a first position and a second position, the first position being a position at which the conductive block is sandwiched between the first intermediate contacts and the second intermediate contacts, and the second position being a position at which the conductive block is not in contact with the first intermediate contacts and the second intermediate contacts, wherein when the conductive block is located at the first position, the conductive block is in contact with the first intermediate contacts and the second intermediate contacts to electrically connect the first intermediate contacts and the second intermediate contacts to each other through the conductive block, and when the conductive block is located at the second position, the first intermediate contacts are brought into contact with the second intermediate contacts, respectively, and the first intermediate contacts and the second intermediate contacts are electrically connected to each other.

13. The apparatus according to claim 12, wherein the substrate holder further includes a holder hanger to which the outer contacts are attached, and the first intermediate contacts, the second intermediate contacts, and the conductive block are housed in the holder hanger.

14. The apparatus according to claim 12, further comprising:

wires extending from the inner contacts to the first intermediate contacts, respectively, the wires being made of metal having an electrical resistance higher than an electrical resistance of copper.

15. The apparatus according to claim 14, wherein the wires are made of copper nickel alloy.

16. The apparatus according to claim 14, wherein the wires have the same length as each other.

17. A substrate holder comprising:

inner contacts to be brought into contact with a periphery of a substrate;

first intermediate contacts electrically connected to the inner contacts, respectively;

the outer contacts to be brought into contact with a feeding terminal coupled to a power source;

second intermediate contacts electrically connected to the outer contacts, respectively; and a conductive block being movable between a first position and a second position, the first position being a position at which the conductive block is sandwiched between the first intermediate contacts and the second intermediate contacts, and the second position being a position at which the conductive block is not in contact with the first intermediate contacts and the second intermediate contacts, wherein when the conductive block is located at the first position, the conductive block is in contact with the first intermediate contacts and the second intermediate contacts to electrically connect the first intermediate contacts and the second intermediate contacts to each other through the conductive block, and when the conductive block is located at the second position, the first intermediate contacts are brought into contact with the second intermediate contacts, respectively, and the first intermediate contacts and the second intermediate contacts are electrically connected to each other.

18. The substrate holder according to claim 17, further comprising a holder hanger to which the outer contacts are attached, and the first intermediate contacts, the second intermediate contacts, and the conductive block are housed in the holder hanger.

19. The substrate holder according to claim 17, further comprising:

wires extending from the inner contacts to the first intermediate contacts, respectively, the wires being made of metal having an electrical resistance higher than an electrical resistance of copper.

20. The substrate holder according to claim 19, wherein the wires are made of copper nickel alloy.

21. The substrate holder according to claim 19, wherein the wires have the same length as each other.

22. A substrate holder comprising:

inner contacts to be brought into contact with a periphery of a substrate;

outer contacts each having elasticity, the outer contacts having contact surfaces, respectively, to be brought into contact with a feeding terminal coupled to a power source, the outer contacts being coupled to the inner contacts, respectively;

a conductive block arranged in back of the contact surfaces; and a biasing member configured to press the conductive block against the outer contacts.

23. The substrate holder according to claim 22, wherein each of the outer contacts comprises a first contact which is in contact with the conductive block, and a second contact extending in a direction away from the conductive block, and the first contact and the second contact are electrically connected to each other.

24. The substrate holder according to claim 22, wherein each of the outer contacts comprises a first projecting portion which is in contact with the conductive block, and a second projecting portion projecting in a direction away from the conductive block.

25. The substrate holder according to claim 24, wherein the first projecting portion is a first bent portion projecting toward the conductive block, and the second projecting portion is a second bent portion projecting in a direction away from the conductive block.

26. The substrate holder according to claim 22, wherein the conductive block is housed in a holder hanger to which the outer contacts are attached.

27. The substrate holder according to claim 22, further comprising:

wires which couple the inner contacts to the outer contacts, respectively, the wires being made of copper nickel alloy.

28. The substrate holder according to claim 27, wherein the wires have the same length as each other.

29. An apparatus for plating a substrate, comprising:

a plating tank for holding a plating solution therein;

a substrate holder configured to hold a substrate and place the substrate in the plating tank;

an anode disposed in the plating tank;

a power source configured to apply a voltage between the substrate and the anode; and a feeding terminal coupled to the power source, wherein the substrate holder comprises:

inner contacts to be brought into contact with a periphery of the substrate;

outer contacts each having elasticity, the outer contacts having contact surfaces, respectively, to be brought into contact with the feeding terminal, the outer contacts being coupled to the inner contacts, respectively;

a conductive block arranged in back of the contact surfaces; and a biasing member configured to press the conductive block against the outer contacts.

30. The apparatus according to claim 29, wherein each of the outer contacts comprises a first contact which is in contact with the conductive block, and a second contact extending in a direction away from the conductive block, and the first contact and the second contact are electrically connected to each other.

31. The apparatus according to claim 29, wherein each of the outer contacts comprises a first projecting portion which is in contact with the conductive block, and a second projecting portion projecting in a direction away from the conductive block.

32. The apparatus according to claim 31, wherein the first projecting portion is a first bent portion projecting toward the conductive block, and the second projecting portion is a second bent portion projecting in a direction away from the conductive block.

33. The apparatus according to claim 29, wherein the substrate holder includes a holder hanger to which the outer contacts are attached, and the conductive block is housed in the holder hanger.

34. The apparatus according to claim 29, further comprising:

wires which couple the inner contacts to the outer contacts, respectively, the wires being made of copper nickel alloy.

35. The apparatus according to claim 34, wherein the wires have the same length as each other.

36. The apparatus according to claim 29, further comprising:

an auxiliary terminal provided on the feeding terminal and configured to be able to come into contact with the conductive block.

37. The apparatus according to claim 29, further comprising:

a resistance-measuring device configured to measure an electrical resistance between the outer contacts, the resistance-measuring device including:

probes being able to come into contact with the outer contacts; and a protrusion configured to separate the conductive block from the outer contacts.

38. A method of plating a substrate using a substrate holder having inner contacts for passing an electric current to the substrate, and further having outer contacts each having an elasticity, the outer contacts being coupled to the inner contacts, respectively, the method comprising:

electrically connecting the outer contacts to each other through a conductive block by pressing the conductive block against the outer contacts by a biasing member;

holding the substrate with the substrate holder and bringing the inner contacts into contact with a periphery of the substrate;

bringing the outer contacts into contact with a feeding terminal on a plating tank while immersing the substrate in a plating solution in the plating tank; and plating the substrate by applying a voltage between an anode and the substrate which are immersed in the plating solution.

39. The method according to claim 38, further comprising:

before holding the substrate with the substrate holder, measuring an electrical resistance between the outer contacts by a resistance-measuring device which is brought into contact with the outer contacts.

40. The method according to claim 38, further comprising:

separating the conductive block from the outer contacts when the substrate holder is holding the substrate; and measuring an electrical resistance between the outer contacts by a resistance-measuring device which is brought into contact with the outer contacts while the conductive block is positioned away from the outer contacts.

* * * * *